US008196321B2

(12) United States Patent
Baker et al.

(10) Patent No.: US 8,196,321 B2
(45) Date of Patent: Jun. 12, 2012

(54) ARTICLE OF FOOTWEAR WITH A SHAPE CORRECTING MEMBER

(75) Inventors: Brian D. Baker, Portland, OR (US); Andrew Caine, Portland, OR (US); John Droege, Portland, OR (US); Tetsuya T. Minami, Portland, OR (US); Erez Morag, Lake Oswego, OR (US); Morgan Stauffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 431 days.

(21) Appl. No.: 12/473,618

(22) Filed: May 28, 2009

(65) Prior Publication Data

US 2010/0299961 A1 Dec. 2, 2010

(51) Int. Cl.
*A43B 5/00* (2006.01)

(52) U.S. Cl. ..... 36/133; 36/88; 36/93

(58) Field of Classification Search ..... 36/88, 133, 36/71, 72 R, 54, 93–96; 128/882, 892–894
See application file for complete search history.

(56) References Cited

U.S. PATENT DOCUMENTS

| | | | | | |
|---|---|---|---|---|---|
| 950,333 | A | * | 2/1910 | Koch | 36/3 A |
| 1,184,013 | A | * | 5/1916 | Pierce | 36/54 |
| 2,918,734 | A | * | 12/1959 | Hyde | 36/89 |
| 2,941,527 | A | * | 6/1960 | Scholl | 602/30 |
| 2,969,062 | A | * | 1/1961 | Landau | 128/894 |
| 3,063,555 | A | * | 11/1962 | Hanington | 206/440 |
| 3,253,591 | A | * | 5/1966 | Scholl | 128/894 |
| 3,325,919 | A | * | 6/1967 | Robinson | 36/93 |
| 3,419,974 | A | * | 1/1969 | Lange | 36/117.6 |
| 3,548,420 | A | * | 12/1970 | Spence | 623/37 |
| 3,668,793 | A | * | 6/1972 | Stohr et al. | 36/71 |
| 3,693,270 | A | * | 9/1972 | Murray | 36/58.5 |
| 3,703,775 | A | | 11/1972 | Gatti | |
| 3,858,337 | A | * | 1/1975 | Vogel | 36/55 |
| 4,065,861 | A | * | 1/1978 | Pelfrey | 36/133 |
| 4,210,245 | A | * | 7/1980 | Dodge | 206/440 |
| 4,342,159 | A | * | 8/1982 | Edwards | 36/77 R |
| 4,385,456 | A | * | 5/1983 | Livernois et al. | 36/115 |
| 4,428,089 | A | * | 1/1984 | Dawber et al. | 12/142 R |
| 4,534,122 | A | * | 8/1985 | MacPhail | 36/88 |
| 4,726,126 | A | * | 2/1988 | Bernhard | 36/89 |
| 5,092,347 | A | * | 3/1992 | Shaffer et al. | 128/892 |
| 5,203,793 | A | | 4/1993 | Lyden | |
| 5,383,290 | A | | 1/1995 | Grim | |

(Continued)

FOREIGN PATENT DOCUMENTS

GB 2413052 10/2005

OTHER PUBLICATIONS

The International Search Report and Written Opinion of the International Searching Authority mailed Jan. 18, 2011 in International Application No. PCT/US2010/036495.

(Continued)

*Primary Examiner* — Marie Patterson
(74) *Attorney, Agent, or Firm* — Plumsea Law Group, LLC

(57) ABSTRACT

An article of footwear with a shape correcting member is disclosed. The shape correcting member includes an inner surface associated with a portion of a foot and an outer surface disposed opposite of the inner surface. The inner surface is pre-shaped to fit the contours of a portion of the foot and the outer surface is substantially non-protruding. With this arrangement, the outer surface may facilitate accurate kicking.

34 Claims, 15 Drawing Sheets

U.S. PATENT DOCUMENTS

| | | | | |
|---|---|---|---|---|
| 5,392,534 | A | 2/1995 | Grim | |
| 5,617,650 | A | 4/1997 | Grim | |
| 5,634,284 | A * | 6/1997 | MacPhail | 36/117.6 |
| 5,740,618 | A * | 4/1998 | Minden | 36/8.3 |
| 5,766,704 | A | 6/1998 | Allen et al. | |
| 5,827,459 | A | 10/1998 | Allen et al. | |
| 5,939,157 | A | 8/1999 | Allen et al. | |
| 5,955,159 | A | 9/1999 | Allen et al. | |
| 5,985,383 | A | 11/1999 | Allen et al. | |
| 6,195,917 | B1 | 3/2001 | Dieckhaus | |
| 6,408,542 | B1 * | 6/2002 | Shepherd | 36/54 |
| 6,442,875 | B1 * | 9/2002 | Joubert et al. | 36/115 |
| 6,543,158 | B2 | 4/2003 | Dieckhaus | |
| 6,618,962 | B1 * | 9/2003 | Covatch | 36/72 R |
| 6,671,981 | B2 * | 1/2004 | Brooks | 36/95 |
| 7,028,419 | B2 * | 4/2006 | Brooks | 36/89 |
| 7,329,448 | B2 * | 2/2008 | Cunningham | 428/40.1 |
| 7,727,608 | B2 * | 6/2010 | Cunningham | 428/40.1 |
| 7,941,943 | B2 * | 5/2011 | Baker et al. | 36/54 |
| 2001/0022039 | A1 | 9/2001 | Krajcir | |
| 2008/0127520 | A1 | 6/2008 | Luedecke et al. | |
| 2009/0100711 | A1 | 4/2009 | Engel | |

OTHER PUBLICATIONS

Invitation to Pay Additional Fees and International Search Report, mailed Nov. 19, 2010 in International Application No. PCT/US2010/036495.

International Preliminary Report on Patentability (including Written Opinion of the ISA) mailed Dec. 8, 2011 in International Application No. PCT/US2010/036495.

* cited by examiner

ARTICLE OF FOOTWEAR WITH A SHAPE CORRECTING MEMBER

BACKGROUND

The present invention relates to an article of footwear, and in particular to an article of footwear with a shape correcting element.

Articles of footwear configured to enhance comfort and fit of an article have previously been proposed. Grim (U.S. Pat. No. 5,617,650) is directed to a vacuum formed conformable shoe. Grim teaches shoes that are provided with soles and/or upper portions which conform to the configuration of the user's feet by the use of vacuum formable bladders in the sole of the shoes and/or in the sides of the upper portions of the shoes. The shoe includes two bladder zones. The bladders are filled with air using a pump, which operates as a wearer walks or runs.

SUMMARY

The invention discloses an article of footwear with a shape correcting element. In one aspect, the invention provides an article of footwear, comprising: a shape correcting member including an inner surface associated with a top portion of a foot and an outer surface disposed opposite of the inner surface; the inner surface including a plurality of pre-formed cavities; and where at least one of the pre-formed cavities is configured to receive a metatarsal bone.

In another aspect, the shape correcting member includes an extended portion associated with the inner surface that is configured to insert between two adjacent metatarsal bones of a foot.

In another aspect, the shape correcting member comprises a substantially rigid material.

In another aspect, the inner surface is shaped to fit to the contours of the top portion of the foot.

In another aspect, the outer surface is substantially non-protruding.

In another aspect, the outer surface is configured to facilitate accurate kicking.

In another aspect, the invention provides an article of footwear, comprising: an upper including a shape correcting member; the shape correcting member disposed on an inner portion of the upper, the shape correcting member including a central hole configured to receive a bony protrusion of a foot; and where the shape correcting member presents a flat surface for the upper in an area adjacent to the bony protrusion.

In another aspect, the shape correcting member has a ring-like shape.

In another aspect, the shape correcting member is configured to associate with a navicular bone of the foot.

In another aspect, the shape correcting member is configured to associate with a calcaneus bone of the foot.

In another aspect, the shape correcting member is configured to associate with a metatarsal head of the foot.

In another aspect, the invention provides an article of footwear, comprising: a shape correcting member including an inner surface associated with a portion of a foot and an outer surface disposed opposite of the inner surface; the inner surface being pre-shaped to fit to the contours of the portion of the foot; and where the outer surface is a substantially non-protruding surface.

In another aspect, the substantially non-protruding outer surface facilitates accurate kicking of a ball.

In another aspect, the outer surface is substantially flat.

In another aspect, the shape correcting member is integrally formed with an upper of the article of footwear.

In another aspect, the shape correcting member may be removably attached to an upper of the article of footwear.

In another aspect, the shape correcting member is integrally formed with a bootie that is configured to be removably inserted into an upper of the article of footwear.

In another aspect, the shape correcting member is a first shape correcting member associated with a first bony protrusion of the foot and wherein the article includes a second shape correcting member associated with a second bony protrusion of the foot.

In another aspect, the first shape correcting member and the second shape correcting member are embedded within a pad.

In another aspect, the shape correcting member comprises a plurality of pre-formed cavities and wherein the plurality of pre-formed cavities are associated with a plurality of bony protrusions of the foot.

In another aspect, the invention provides an article of footwear, comprising: an upper including a lacing region; the lacing region including a medial lacing edge and a lateral lacing edge, the medial lacing edge and the lateral lacing edge being separated by a lacing gap; a shape correcting portion having a shape corresponding to the lacing gap; and wherein the shape correcting portion is disposed adjacent to the lacing gap when the upper is tightened around a foot and wherein the shape correcting member provides a substantially non-protruding surface for the upper at the lacing gap.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following figures and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
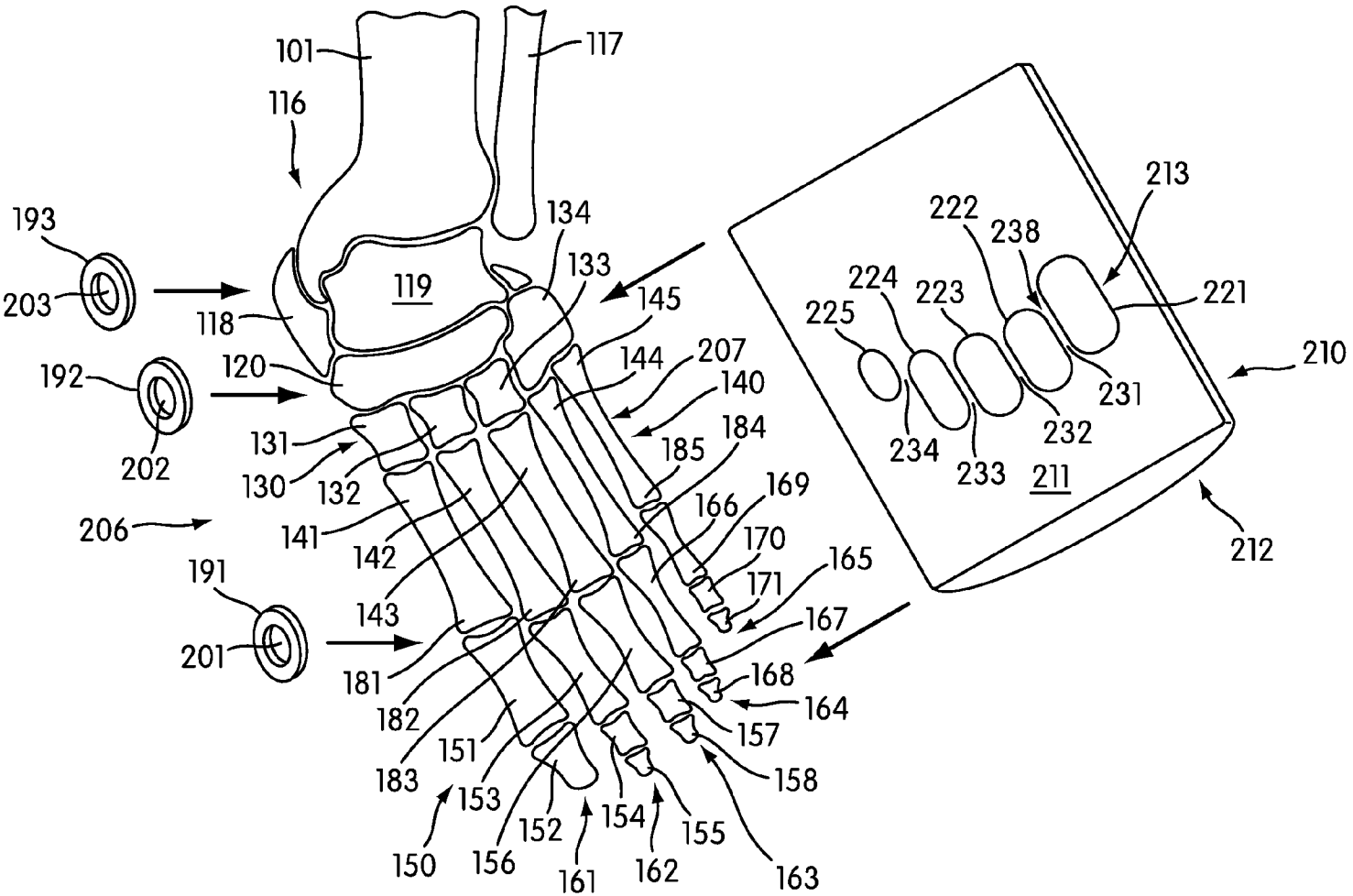
FIG. 1 is an exploded isometric view of an exemplary embodiment of a foot and a shape correcting member.
Figure 2:
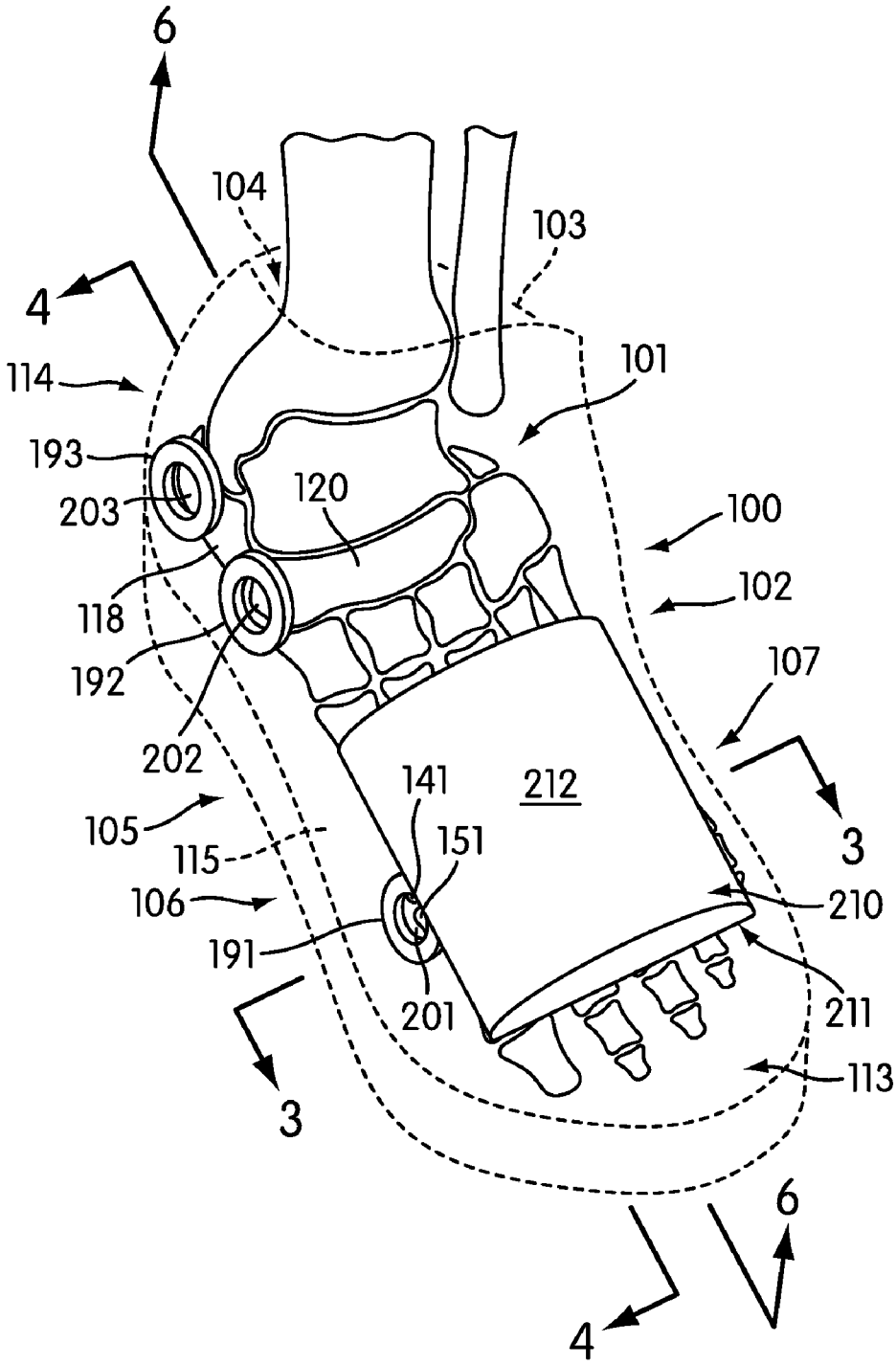
FIG. 2 is a schematic isometric view of an exemplary embodiment of a foot associated with shape correcting members disposed within an article of footwear illustrated in phantom.

FIGS. 1 and 2 are isometric views of an exemplary embodiment of foot 101. In particular, FIG. 1 is an isometric view of an exemplary embodiment of foot 101 and FIG. 2 is an isometric view of an exemplary embodiment of foot 101 disposed within article of footwear 100, also referred to simply as article 100. For clarity, article of footwear 100 is illustrated in phantom.

In one embodiment, article 100 is a soccer shoe. However, in other embodiments, article 100 may be any type of footwear, including, but not limited to: a football shoe, a rugby shoe, a sneaker, a running shoe, a basketball shoe, a high heel shoe, a boot, a high top shoe, a low top shoe, as well as other types of footwear. As shown in FIG. 2, article of footwear 100 is intended to be used with a left foot; however, it should be understood that the following discussion may equally apply to a mirror image of article of footwear 100 that is intended for use with a right foot.

In different embodiments, article 100 may comprise different portions. In an exemplary embodiment, article 100 includes upper 102. Generally, upper 102 may be any type of upper. In particular, upper 102 may have any design, shape, size and/or color.

Upper 102 is configured to receive a foot of a wearer. In some embodiments, upper 102 includes throat 103 configured to receive a foot of a wearer. Typically, throat 103 allows a foot to be inserted into inner portion 104 of article 100.

Upper 102 may include medial portion 106. Also, upper 102 may include lateral portion 107 disposed opposite medial portion 106. Typically, medial portion 106 may be associated with an inside of a foot. Similarly, lateral portion 107 may be associated with an outside of a foot.

Upper 102 may include toe portion 113 that is associated with the toes of a foot. Also, upper 102 may include heel portion 114 that is associated with a heel of a foot. Upper 102 may also include middle portion 115 that is disposed between toe portion 113 and heel portion 114. Typically, middle portion 115 is associated with a midfoot, including an arch of the foot and a top of the foot.

For clarity, only some portions of article 100 are discussed in this embodiment. For example, article 100 may be associated with a sole system. The sole system may comprise multiple components, including, but not limited to: an outsole, a midsole, and an insole. In addition, article 100 may be associated with various types of fastening systems including, but not limited to: laces, straps, zippers, hook and loop fasteners, as well as other types of fastening systems. However, in other embodiments, article 100 may be a slip-on type of article of footwear that does not require fastening.

An article of footwear may include provisions to conform to a shape of a foot to provide comfort and a good fit for a foot inserted within the article. In particular, an article may conform to bones of a foot to provide comfort and a good fit to a foot. Referring to FIG. 1, bones of foot 101 are visible for illustrative purposes.

Bones of an ankle portion of foot 101 comprise medial malleolus 116 and lateral malleolus 117. Medial malleolus 116 is disposed on medial portion 206 of foot 101. Similarly, lateral malleolus 117 is disposed on lateral portion 207 of foot 101.

The bones of a heel portion of foot 101 include calcaneus 118 and talus 119. In particular, calcaneus 118 is the largest bone of foot 101 and comprises a substantial majority of the heel portion of foot 101. Furthermore, calcaneus 118 is disposed below talus 119.

The middle portion of foot 101 includes navicular bone 120, cuneiform bones 130, cuboid 134 and metatarsal bones 140. Cuneiform bones 130 are disposed between navicular bone 120 and metatarsal bones 140 and are medial to cuboid bone 134. In particular, cuneiform bones 130 include medial cuneiform 131, intermediate cuneiform 132 and lateral cuneiform 133. In a similar manner, metatarsal bones 140 comprise first metatarsal bone 141, second metatarsal bone 142, third metatarsal bone 143, fourth metatarsal bone 144 and fifth metatarsal bone 145.

The toe portion of foot 101 includes phalanx bones 150. In particular, phalanx bones 150 include first proximal bone 151 and distal bone 152 of great toe 161 of foot 101. Similarly, second toe 162 of foot 101 includes second proximal bone 153, middle bone 154 and distal bone 155. Likewise, third toe 163 of foot 101 comprises third proximal bone 156, middle bone 157 and distal bone 158. In addition, fourth toe 164 of foot 101 includes fourth proximal bone 166, middle bone 167 and distal bone 168. Finally, fifth toe 165 comprises fifth proximal bone 169, middle bone 170 and distal bone 171.

In some embodiments, a portion of an article may be disposed against one or more bony protrusions of a foot. The term "bony protrusion" as used throughout this detailed description and in the claims refers to any portion of a bone that may protrude or otherwise extend outwards from a portion of a foot. Examples of bones in a foot that may include bony protrusions include, but are not limited to: metatarsals, phalanxes, navicular and calcaneus bones.

In some cases, the surface of the article may protrude outwards in a region adjacent to a bony protrusion. For example, an upper of an article may bulge outwards in a region around a head of the first metatarsal that is disposed adjacent to a proximal bone of a great toe. In some cases, this arrangement may cause a bumpy or irregular surface in the upper. Likewise, an upper may have a bumpy or irregular surface in regions associated with other types of bony protrusions of a foot.

In some embodiments, an article may include shape correcting provisions so that the article presents a non-protruding surface in an area adjacent to a bony protrusion of a foot. The term "non-protruding surface," as used throughout this detailed description and in the claims, refers to a surface having a shape without sharp changes in direction caused by, e.g., bony protrusions of the foot. In some cases, a non-protruding surface may be curved. For example, a non-protruding surface of an article adjacent to a toe portion of an article may be rounded. In other cases, a non-protruding surface may be substantially flat. For example, a medial portion of an article may include a non-protruding surface that is substantially flat. A non-protruding surface may include texture or nubs as, e.g., would be used for ball control in a soccer shoe, so long as the bulk of the material forming the non-protruding surface does not have sharp changes in direction.

In some embodiments, an article may include a shape correcting member to present a non-protruding surface in an area adjacent to a bony protrusion of a foot. In particular, an outer surface of a shape correcting member may comprise a substantially non-protruding surface. In addition, an inner surface of the shape correcting member may be configured to receive a bony protrusion of a foot. With this arrangement, the shape correcting member may present a non-protruding surface adjacent to a bony protrusion of a foot.

In an exemplary embodiment, shape correcting members may be disposed adjacent to bony protrusions of medial portion 206 of foot 101. Referring to FIG. 1, three shape correcting members may be associated with bony protrusions of medial portion 206 of foot 101. In particular, first shape correcting member 191 may be disposed adjacent to a protrusion at first metatarsal bone 141 and first proximal bone 151 of great toe 161. Similarly, second shape correcting member 192 may be disposed adjacent to navicular bone 120. Finally, third shape correcting member 193 may be disposed adjacent to calcaneus 118.

Generally, a shape correcting member may be configured in various manners to receive bony protrusions of a foot. In some embodiments, an inner surface of a shape correcting member may include a pre-formed cavity to receive a bony protrusion of a foot. In some cases, a shape correcting member may include a plurality of pre-formed cavities to receive more than one bony protrusion of a foot. In other embodiments, a shape correcting member may include a central hole configured to receive a bony protrusion of a foot.

Referring to FIGS. 1 and 2, first shape correcting member 191 includes first central hole 201 to receive a bony protrusion of first metatarsal bone 141 and proximal bone 151 of great toe 161. In a similar manner, second shape correcting member 192 may include second central hole 202 to receive a bony protrusion of navicular bone 120. In addition, third shape correcting member 193 may comprise third central hole 203 to receive a bony protrusion of calcaneus 118.

Generally, a shape correcting member may be configured with various shapes to present a non-protruding surface in an area adjacent to a bony protrusion of a foot. Shapes for a shape correcting member include, but are not limited to: circular shapes, ring-like shapes, square shapes, rectangular shapes, elliptical shapes, triangular shapes, regular shapes, irregular shapes as well as other types of shapes. In some embodiments, a shape correcting member may be configured with a size and shape to receive more than one bony protrusion of a foot. In other embodiments, a shape correcting member may be configured with a size and shape to receive one bony protrusion of a foot.

In an exemplary embodiment, first shape correcting member 191, second shape correcting member 192 and third shape correcting member 193 may be configured with ring-like shapes. Furthermore, first shape correcting member 191, second shape correcting member 192 and third shape correcting member 193 may be configured with sufficient thicknesses so that associated bony protrusions do not protrude from first shape correcting member 191, second shape correcting member 192 and third shape correcting member 193, as illustrated in FIG. 2. Using this configuration, first shape correcting member 191, second shape correcting member 192 and third shape correcting member 193 may present a non-protruding surface in areas adjacent to bony protrusions of first metatarsal bone 141 and first proximal bone 151, navicular bone 120 and calcaneus 118.

In some embodiments, first shape correcting member 191, second shape correcting member 192 and third shape correcting member 193 may be disposed on inner portion 104 of upper 102. This arrangement allows first shape correcting member 191, second shape correcting member 192 and third shape correcting member 193 to present a flat surface for medial portion 106 of upper 102 in areas adjacent to bony protrusions of first metatarsal bone 141 and first proximal bone 151, navicular bone 120 and calcaneus 118. Details of the association of first shape correcting member 191, second shape correcting member 192 and third shape correcting member 193 with an article will be discussed later in this detailed description.

A top portion of a foot may also be associated with a shape correcting member. In some embodiments, a top portion of a foot may be associated with more than one shape correcting member. In other embodiments, a top portion of a foot may be associated with one shape correcting member configured to receive more than one bony protrusion of a foot. In one embodiment, a top portion of a foot may be associated with an inner surface of a shape correcting member that includes a plurality of pre-formed cavities configured to receive bony protrusions of the top portion of a foot.

Referring to FIG. 1, a top portion of foot 101 may be associated with top shape correcting member 210. In particular, a top portion of foot 101 may be associated with inner surface 211 of top shape correcting member 210. In addition, top shape correcting member 210 includes outer surface 212 disposed opposite inner surface 211. In one embodiment, top shape correcting member 210 may be configured with a rectangular shape. However, in other embodiments, top shape correcting member 210 may be configured with other shapes suitable for a shape correcting member as previously discussed.

In an exemplary embodiment, inner surface 211 includes plurality of pre-formed cavities 213. Generally, plurality of pre-formed cavities 213 may include any number of cavities. In some embodiments, plurality of pre-formed cavities 213 include cavities to receive bony protrusions of metatarsal bones 140 of foot 101. In other embodiments, plurality of pre-formed cavities 213 may include cavities to receive bony protrusions of phalanx bones 150 of foot 101. In still other embodiments, plurality of pre-formed cavities 213 may include cavities to receive bony protrusions of metatarsal bones 140 and phalanx bones 150 of foot 101. In one embodiment, plurality of pre-formed cavities 213 include cavities to receive bony protrusions of metatarsal bones 140 and proximal bones of phalanx bones 150 of foot 101.

In particular, plurality of pre-formed cavities 213 may include first cavity 221, second cavity 222, third cavity 223, fourth cavity 224 and fifth cavity 225 to receive heads of metatarsal bones 140 and a portion of proximal bones of phalanx bones 150. In some cases, first cavity 221 may be configured to receive first head 181 of first metatarsal bone 141 and an adjacent portion of first proximal bone 151. Likewise, second cavity 222 may receive second head 182 of second metatarsal bone 142 and an adjacent portion of second proximal bone 153. Similarly, third cavity 223 may receive third head 183 of third metatarsal bone 143 and an adjacent portion of third proximal bone 156. Also, fourth cavity 224 may receive fourth head 184 of fourth metatarsal bone 144 and an adjacent portion of fourth proximal bone 166. Finally, fifth cavity 225 may receive fifth head 185 of fifth metatarsal bone 145 and an adjacent portion of fifth proximal bone 169.

Although the current embodiment includes shape correcting members including holes or cavities, in other embodiments a hole or cavity of a shape correcting member can be filled with one or more materials. In one embodiment, first cavity 221, second cavity 222, third cavity 223, fourth cavity 224 and fifth cavity 225 may be filled with a material having a different rigidity than a material comprising top shape correcting member 210. For example, in one embodiment, first cavity 221, second cavity 222, third cavity 223, fourth cavity 224 and fifth cavity 225 may be filled with a foam material, while top shape correcting member 210 may be made of a durable rubber material that is more rigid than the foam material. With this arrangement, bony protrusions may still be received within first cavity 221, second cavity 222, third cavity 223, fourth cavity 224 and fifth cavity 225 as the foam material filling these cavities may be deformed around the bony protrusions.

In another embodiment, first central hole 201, second central hole 202 and third central hole 203 of first shape correcting member 191, second shape correcting member 192 and third shape correcting member 193, respectively, may be filled with a foam material. In addition, first shape correcting member 191, second shape correcting member 192 and third shape correcting member 193 may be made of a durable rubber that is more durable than the foam material. With this arrangement, bony protrusions may still be received within first central hole 201, second central hole 202 and third central hole 203 as the foam material filling these cavities may be deformed around the bony protrusions.

In some embodiments, inner surface 211 of top shape correcting member 210 may include additional provisions to fit to the contours of a top of foot 101. In one embodiment, inner surface 211 may include extended portions 238. Extended portions 238 may be disposed between plurality of pre-formed cavities 213. In some cases, extended portions 238 may be inserted between two adjacent metatarsal bones 140 of foot 101. With this arrangement, extended portions 238 may facilitate the fit of metatarsal bones 140 within plurality of pre-formed cavities 213.

Figure 3:
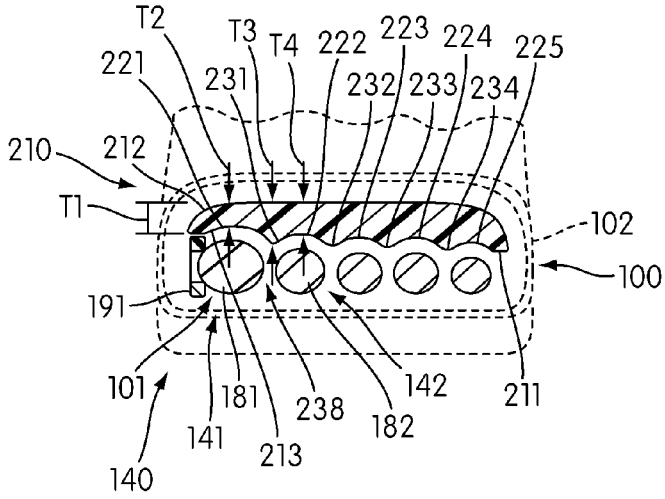
FIG. 3 is a schematic cross sectional view of an exemplary embodiment of a foot disposed in an article of footwear with shape correcting members.

Referring to FIG. 3, extended portions 238 includes first extended portion 231, second extended portion 232, third extended portion 233, and fourth extended portion 234 configured to insert between each adjacent pair of metatarsal bones 140. In some cases, first extended portion 231 may be inserted between first metatarsal bone 141 and second metatarsal bone 142. Similarly, second extended portion 232 may be inserted between second metatarsal bone 142 and third metatarsal bone 143. In addition, third extended portion 233 may be inserted between third metatarsal bone 143 and fourth metatarsal bone 144. Finally, fourth extended portion 234 may be inserted between fourth metatarsal bone 144 and fifth metatarsal bone 145. Using this configuration of extended portions 238 and plurality of pre-formed cavities 213, inner surface 211 is shaped to fit the contours of a top of foot 101.

Referring to FIG. 2, outer surface 212 of top shape correcting member 210 is substantially non-protruding. In some embodiments, outer surface 212 may be a substantially flat surface. In an exemplary embodiment, outer surface 212 is rounded with an approximately constant curvature. This arrangement allows outer surface 212 of top shape correcting member 210 to present a non-protruding surface for middle portion 115 and toe portion 113 of upper 102 in areas adjacent to bony protrusions of metatarsal bones 140 and proximal bones of phalanx bones 150.

Figure 4:
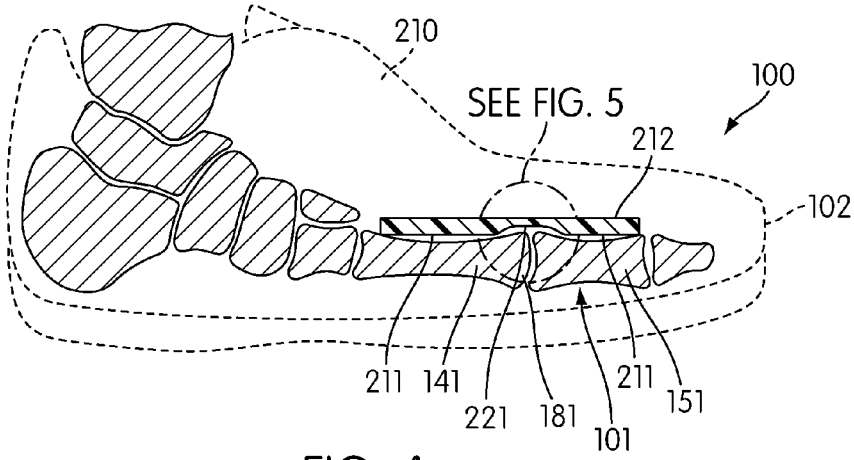
FIG. 4 is a schematic cross sectional view of an exemplary embodiment of a foot disposed in an article of footwear with shape correcting members.
Figure 5:
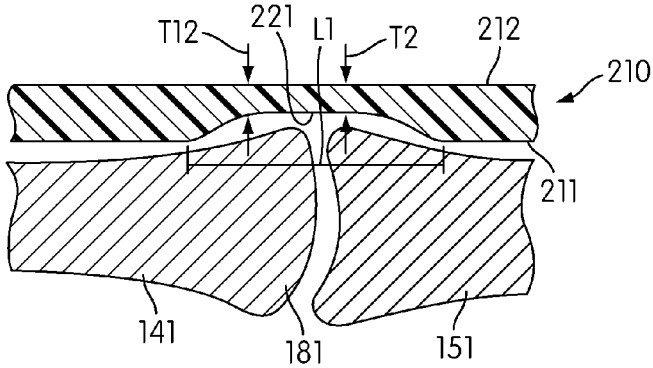
FIG. 5 is a enlarged cross sectional view of an exemplary embodiment of a portion of a foot disposed adjacent to a shape correcting member.

FIGS. 3-5 illustrate cross sectional views of an embodiment of top shape correcting member 210 disposed within article 100. Referring to FIG. 3, inner surface 211 of top shape correcting member 210 is shaped to fit the contours of a top of foot 101. For purposes of clarity, the fit of top shape correcting member 210 is discussed with respect to a top of foot 101. However, it should be understood that top shape correcting member 210 is pre-formed and configured to fit a top of any foot.

By configuring top shape correcting member 210 with varying thicknesses, inner surface 212 may be shaped to fit the contours of the top of foot 101. In other words, a distance between inner surface 211 and outer surface 212 may vary in order to fit the contours of a top of foot 101 and provide a non-protruding surface for outer surface 212. In one embodiment, top shape correcting member 210 may be configured with first thickness T1. First thickness T1 may represent the distance between inner surface 211 and outer surface 212 in a portion of top shape correcting member 210 excluding plurality of pre-formed cavities 213 and extended portions 238.

As previously discussed, inner surface 211 includes plurality of pre-formed cavities 213 configured to receive heads of metatarsal bones 140. In some embodiments, cavities of plurality of pre-formed cavities 213 may be configured with substantially similar thicknesses to receive heads of metatarsal bones 140. In other embodiments, plurality of pre-formed cavities 213 may be configured with different thicknesses to receive heads of metatarsal bones 140. For example, first cavity 221 may be configured with second thickness T2 to receive first head 181 of first metatarsal bone 141. Similarly, second cavity 222 may be configured with third thickness T3 to receive second head 182 of second metatarsal bone 142. In some cases, second thickness T2 may be less than third thickness T3 to accommodate the greater size of first head 181 of first metatarsal bone 141 than second head 182 of second metatarsal bone 142. In addition, second thickness T2 and third thickness T3 may be less than first thickness T1. This allows inner surface 211 to fit the contours of a top portion of foot 101 adjacent to first metatarsal bone 141 and second metatarsal bone 142. In some embodiments, third cavity 223, fourth cavity 224 and fifth cavity 225 may have a thickness substantially similar to thickness T3 of second cavity 222. Using this arrangement, inner surface 211 may receive heads of metatarsal bones 140 in plurality of pre-formed cavities 213 and fit contours to a top of foot 101.

In order to insert between two adjacent metatarsal bones of foot 101, extended portions 238 of top shape correcting member 210 may be configured with varying thicknesses. In some cases, extended portions 238 may be configured with thicknesses that are less than first thickness T1. In other cases, extended portions 238 may be configured with thicknesses that are greater than first thickness T1. In still other cases, some extended portions 238 may be configured with thicknesses that are greater than first thickness T1 and some extended portions 238 may be configured with thicknesses that are less than first thickness T1.

In one embodiment, first extended portion 231 may be configured with fourth thickness T4. Fourth thickness T4 may be greater than first thickness T1. This greater thickness allows first extended portion 231 to insert between first metatarsal bone 141 and second metatarsal bone 142. In addition, second extended portion 232, third extended portion 233 and fourth extended portion 234 may be configured with thicknesses substantially similar to fourth thickness T4 of first extended portion 231. With this arrangement, top shape correcting member 210 may be configured with extended portions 238 that insert between two adjacent metatarsal bones 140 while maintaining a consistent first thickness T1 to provide a non-protruding surface for outer surface 212.

Referring to FIG. 4, top shape correcting member 210 extends over a substantial majority of first metatarsal bone 141 and first proximal bone 151. Furthermore, first cavity 221 extends in a longitudinal direction length L1 to receive first head 181 of first metatarsal bone 141 as well as first proximal bone 151 of great toe 161. The term "longitudinal" as used throughout this detailed description and in the claims refers to a direction extending a length of a foot. In some cases, length L1 may be associated with a length of a bony protrusion of first head 181 of first metatarsal bone 141 and first proximal bone 151 of great toe 161. Although not shown in FIG. 4, it should be understood that the remaining cavities of plurality of pre-formed cavities 213 may also be configured with lengths to accommodate bony protrusions of a top of foot 101. With this arrangement, inner surface 211 may fit the contours of a top of foot 101 while outer surface 212 provides a non-protruding flat surface for upper 102 in areas adjacent to bony protrusions.

Generally, pre-formed cavities may be configured with regular as well as irregular shapes to receive bony protrusions of a foot. For example, first cavity 221 may be associated with varying thicknesses to fit bony protrusions of first head 181 of first metatarsal bone 141 and a portion of first proximal bone 151 of great toe 161. As previously discussed, first cavity 221 may be associated with second thickness T2. However, first cavity 221 may also be configured with twelfth thickness T12. Twelfth thickness T12 may be greater than second thickness T2. With this arrangement, first cavity 221 may be configured with a shape to fit a contour of a bony protrusion of first head 181 of first metatarsal bone 141 and a portion of first proximal bone 151 of great toe 161. The remaining cavities of plurality of pre-formed cavities 213, as illustrated in FIG. 1, may also be configured in a substantially similar manner. In other words, plurality of pre-formed cavities 213 may be shaped to fit to the contours of a top of foot 101.

Figure 6:
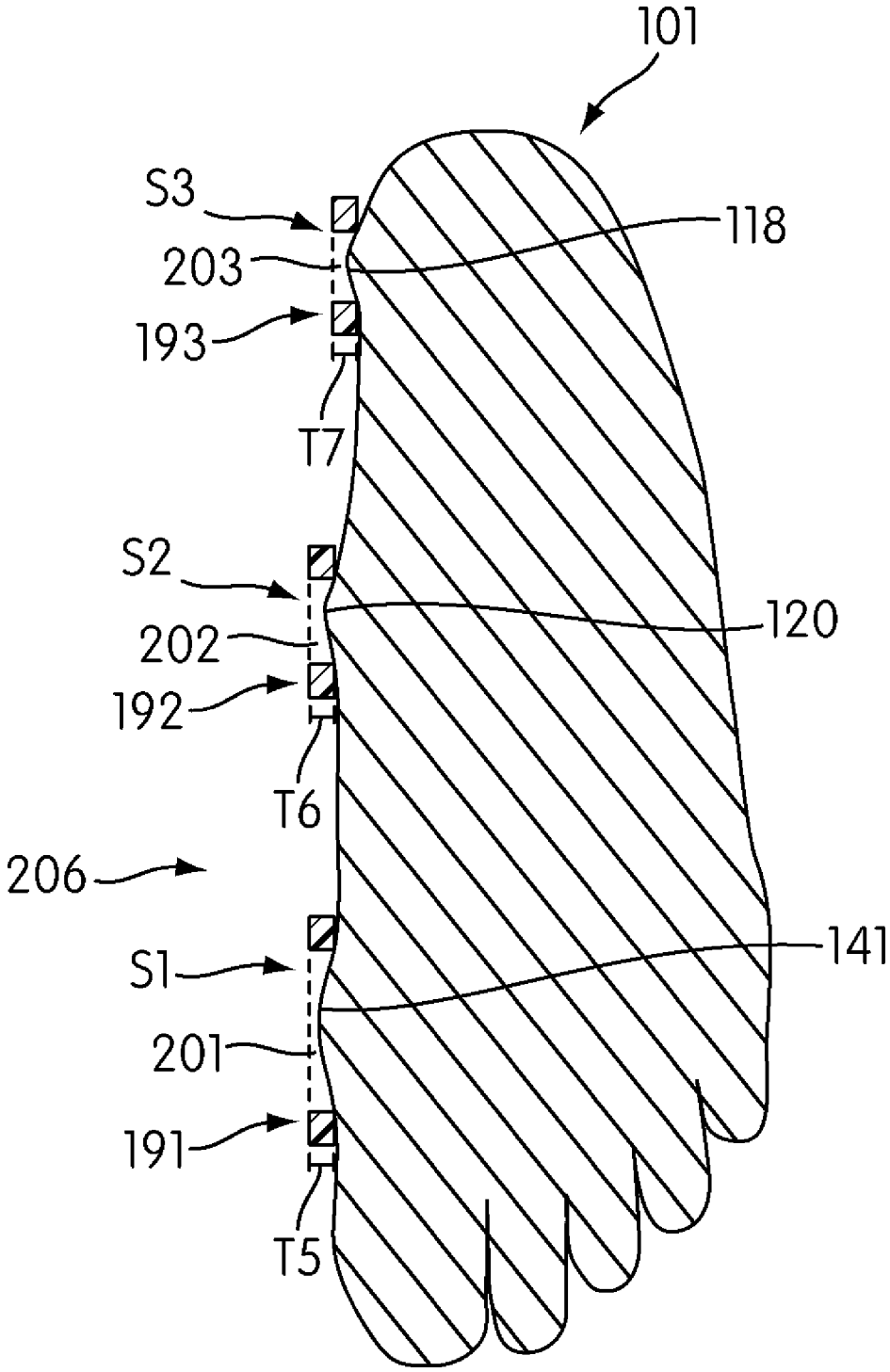
FIG. 6 is a schematic cross sectional view of an exemplary embodiment of a foot disposed adjacent to three shape correcting members.

FIG. 6 illustrates a cross sectional view of an embodiment of first shape correcting member 191, second shape correcting member 192 and third shape correcting member 193 associated with medial portion 206 of foot 101. Although first shape correcting member 191, second shape correcting member 192, and third shape correcting member 193 are discussed with respect to foot 101 for purposes of clarity, it should be understood that first shape correcting member 191, second shape correcting member 192 and third shape correcting member 193 are pre-formed and configured to fit bony protrusions of any foot.

In one embodiment, first shape correcting member 191, second shape correcting member 192 and third shape correcting member 193 may form a substantially non-protruding flat surface for an upper in an area adjacent to bony protrusions of first metatarsal bone 141, navicular bone 120 and calcaneus 118. This may be accomplished by configuring first shape correcting member 191, second shape correcting member 192 and third shape correcting member 193 with sufficient thicknesses to form a substantially non-protruding flat surface with bony protrusions of first metatarsal bone 141, navicular bone 120 and calcaneus 118. For example, in some cases, first shape correcting member 191 may be configured with fifth thickness T5. Fifth thickness T5 may be substantially similar to a thickness of a bony protrusion of first metatarsal bone 141 on medial portion 206 of foot 101. In other words, first shape correcting member 191 and a bony protrusion of first metatarsal bone 141 may be substantially aligned with each other in a lateral direction. The term "lateral direction" as used throughout this detailed description and in the claims, refers to a direction extending a width of a foot. With this arrangement, first shape correcting member 191 may present a flat surface, illustrated for purposes of clarity as first surface S1, for an upper in an area adjacent to a bony protrusion of first metatarsal bone 141.

In a similar manner, second shape correcting member 192 may be configured with sixth thickness T6. Sixth thickness T6 may be substantially similar to a thickness of a bony protrusion of navicular bone 120 on medial portion 206 of foot 101. This configuration allows second shape correcting member 192 to form a substantially non-protruding flat surface illustrated for purposes of clarity as second surface S2. In addition, third shape correcting member 193 may be configured with seventh thickness T7. Seventh thickness T7 may be substantially similar to a thickness of a bony protrusion of calcaneus 118 on medial portion 206 of foot 101. Using this configuration, third shape correcting member 193 may form a substantially non-protruding flat surface, shown for illustrative purposes as third surface S3.

Figure 7:
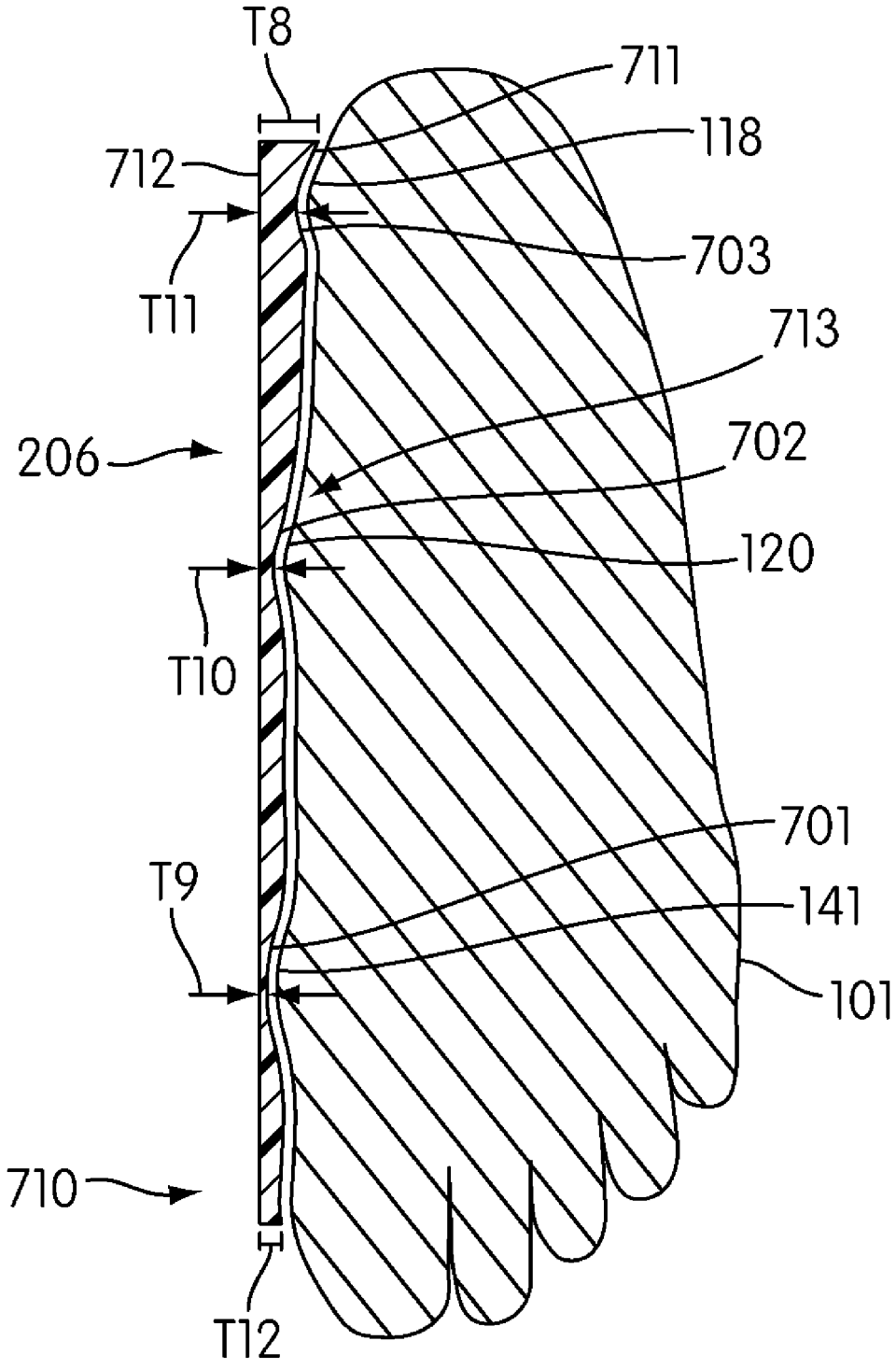
FIG. 7 is a schematic cross sectional view of an exemplary embodiment of a foot disposed adjacent to a shape correcting member.

In some embodiments, a shape correcting member may present a non-protruding surface over a substantial portion of a medial portion of a foot. Referring to FIG. 7, shape correcting member 710 may be associated with medial portion 206 of foot 101. In an exemplary embodiment, shape correcting member 710 may extend along a substantial portion of medial portion 206 of foot 101. In particular, inner surface 711 of shape correcting member 710 may be disposed adjacent to medial portion 206. In addition, shape correcting member 710 includes outer surface 712, disposed opposite inner surface 711. By configuring outer surface 712 with a flat surface, shape correcting member 710 may present a flat non-protruding surface for an upper along medial portion 206 of foot 101.

In order to present a flat non-protruding surface for an upper on medial portion 206 of foot 101, inner surface 711 may be pre-shaped to fit to contours of medial portion 206 of foot 101. This pre-shaping of inner surface 711 may be accomplished by varying thicknesses of shape correcting member 710 to fit to contours of medial portion 206 of foot 101. For example, a toe portion of foot 101 may extend outward in a lateral direction on medial portion 206 farther than a heel portion of foot 101. In one embodiment, shape correcting member 710 may be configured with eighth thickness T8 adjacent to a heel portion of foot 101 and twelfth thickness T12 adjacent to a toe portion of foot 101. In some cases, twelfth thickness T12 may be less than eighth thickness T8. With these different widths, inner surface 711 may be pre-shaped to fit to contours of a heel portion and a toe portion of foot 101. Furthermore, shape correcting member 710 may be configured with varying widths to accommodate contours of medial portion 206 of foot 101. This arrangement of varying widths of shape correcting member 710 may allow inner surface 711 to fit to a contour of medial portion 206 of foot 101 while providing outer surface 712 with a non-protruding flat surface.

In some embodiments, inner surface 711 may include provisions to receive a plurality of bony protrusions disposed on medial portion 206 of foot 101. In one embodiment, inner surface 711 includes plurality of pre-formed cavities 713 that are configured to receive bony protrusions of medial portion 206 of foot 101. In some cases, plurality of pre-formed cavities 713 may include first cavity 701, second cavity 702 and third cavity 703. First cavity 701 may be configured to receive a bony protrusion of first metatarsal bone 141 on medial portion 206. Similarly, second cavity 702 may be configured to receive a bony protrusion of navicular bone 120 on medial portion 206. Finally, third cavity 703 may be configured to receive a bony protrusion of calcaneus 118 on medial portion 206.

Plurality of pre-formed cavities 713 may be configured with various thicknesses to receive bony protrusions of medial portion 206 and present a non-protruding flat surface for outer surface 712. For example, first cavity 701 may be configured with ninth thickness T9. Ninth thickness T9 may be associated with a thickness of a bony protrusion of first metatarsal bone 141 on medial portion 206. Likewise, second cavity 702 may be configured with tenth thickness T10. Tenth thickness T10 may be associated with a thickness of a bony protrusion of navicular bone 120 on medial portion 206. In a similar manner, third cavity 703 may be configured with eleventh thickness T11. Eleventh thickness T11 may be associated with a thickness of a bony protrusion of calcaneus 118 on medial portion 206. In some cases, ninth thickness T9, tenth thickness T10 and eleventh thickness T11 may be less than eighth thickness T8. Using this arrangement, plurality of pre-formed cavities 713 may accommodate bony protrusions of medial portion 206. This arrangement allows inner surface 711 to fit to a contour of medial portion 206 while configuring outer surface 712 with a substantially non-protruding flat surface.

In different embodiments, a shape correcting member may be associated with an article in various manners. In some embodiments, a shape correcting member may be associated with an outer portion of an upper of an article. In other embodiments, a shape correcting member may be associated with an inner portion of an upper of an article. In some cases, a shape correcting member may be integrally formed with an upper of an article. For example, in embodiments where a shape correcting member is associated with an inner portion of an upper, the inner portion of the upper may have carved out portions that form a shape correcting member. In other words, carved out portions may form cavities to receive bony protrusions of a foot. In other cases, a shape correcting member may be fixedly attached to an article. A shape correcting member may be fixedly attached to an article in any manner known in the art, including, but not limited to: hook and loop type fasteners, adhesives, stitching, as well as other manners known in the art.

In some embodiments, a shape correcting member may be fixedly attached to an article during a manufacturing process. In other embodiments, however, a shape correcting member may be fixedly attached to an article post-manufacturing. For example, after a customer purchases an article, a customer may fixedly attach a shape correcting member to the article. In some cases, the shape correcting member may be purchased separately from the article. This arrangement allows a wearer to apply a shape correcting member to any article of footwear.

Figure 8:
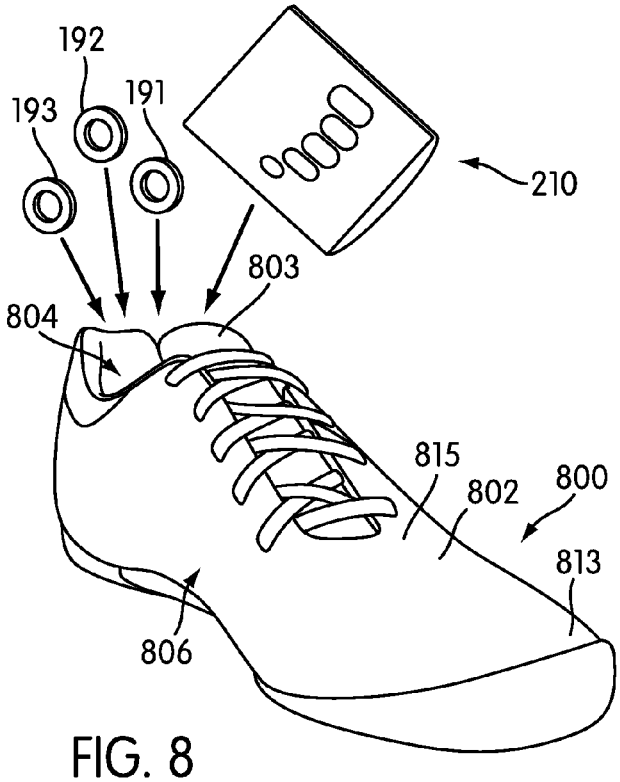
FIG. 8 is an exploded view of an exemplary embodiment of an article of footwear with shape correcting members.

Referring to FIG. 8, first shape correcting member 191, second shape correcting member 192, third shape correcting member 193 and top shape correcting member 210 may be associated with article of footwear 800. In some embodiments, article of footwear 800 is a soccer shoe. However, in other embodiments, article 800 may be any type of footwear, including, but not limited to: a football shoe, a rugby shoe, a sneaker, a running shoe, a basketball shoe, a high heel shoe, a boot, a high top shoe, a low top shoe, as well as other types of footwear.

In an exemplary embodiment, article of footwear 800 includes upper 802. In some embodiments, first shape correcting member 191, second shape correcting member 192, third shape correcting member 193 and top shape correcting member 210 may be associated with inner portion 804 of upper 802. In some cases, first shape correcting member 191, second shape correcting member 192, third shape correcting member 193 and top shape correcting member 210 may be inserted into throat 803 of upper 802 and fixedly attached to inner portion 804. Attachment may be made by any means known in the art including, but not limited to, hook and loop fasteners and a pocket into which first shape correcting member 191, second shape correcting member 192, third shape correcting member 193 and top shape correcting member 210 could be inserted. In other cases, first shape correcting member 191, second shape correcting member 192, third shape correcting member 193 and top shape correcting member 210 may be inserted through a fastening portion of upper 102 and fixedly attached to inner portion 804.

Following attachment to inner portion 804, first shape correcting member 191, second shape correcting member 192 and third shape correcting member 193 may receive bony protrusions on a medial portion of a foot and provide a non-protruding surface to medial portion 806 of article 800. In addition, top shape correcting member 210 may receive bony protrusions on a top portion of a foot and provide a non-protruding surface to middle portion 815 and toe portion 813 of article 800. With this arrangement, first shape correcting member 191, second shape correcting member 192, third shape correcting member 193 and top shape correcting member 210 may correct a shape of a foot so that article 800 presents a non-protruding surface in an area adjacent to bony protrusions of a foot.

Figure 9:
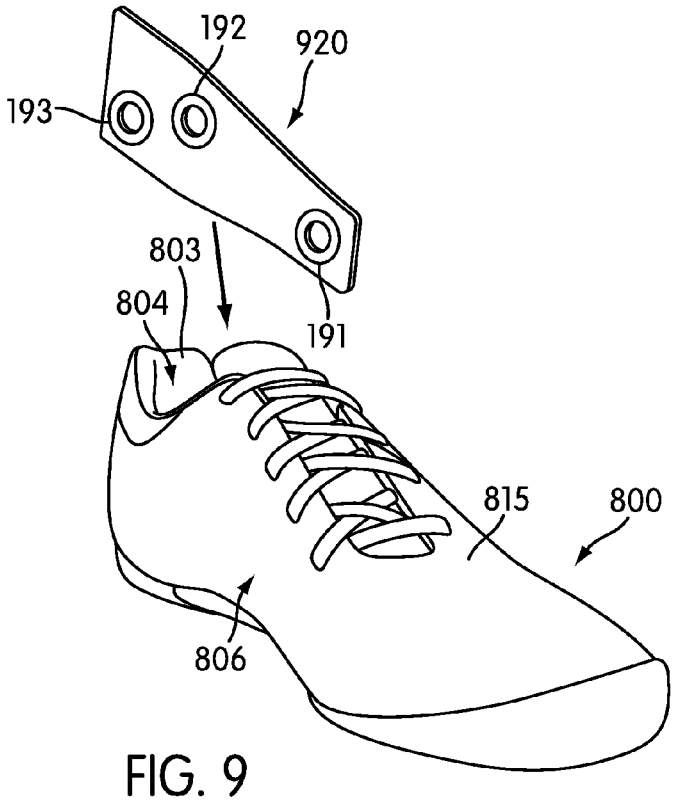
FIG. 9 is an exploded view of an exemplary embodiment of an article of footwear with a shape correcting member.

In some embodiments, a shape correcting member may be associated with a pad in order to facilitate the attachment of the shape correcting member to an article. In some cases, a plurality of shape correcting members may be embedded in a pad to facilitate the attachment of the plurality of shape correcting members to an article. The embedding of a shape correcting member in a pad may be accomplished in any manner known in the art including, stamping, molding, stitching, adhesives as well as other manners known in the art. Referring to FIG. 9, first shape correcting member 191, second shape correcting member 192 and third shape correcting member 193 may be embedded in pad 921.

Generally, pad 920 may be constructed from various suitable materials. Materials suitable for pad 920 include, but are not limited to: leather, foam, plastic, fabric as well as other materials. In some cases, pad 920 may be constructed from substantially flexible materials. In other cases, pad 920 may comprise substantially rigid materials. For example, pad 920 may comprise a substantially rigid material that maintains the relative spacing between embedded shape correcting members.

Pad 921 may comprise various shapes and sizes including, but not limited to: square shapes, rectangular shapes, elliptical shapes, triangular shapes, regular shapes, irregular shapes as well as other types of shapes. Typically, pad 921 may comprise a shape that facilitates the attachment of embedded shape correcting members as well as conforms to contours of an associated article. In one embodiment, pad 921 may comprise a contoured rectangular shape.

With first shape correcting member 191, second shape correcting member 192 and third shape correcting member 193 embedded in pad 920, pad 920 may be inserted into article of footwear 800. In some cases, pad 920 may be inserted into article 800 through throat 803. After insertion of pad 920, pad 920 may be fixedly attach to inner portion 804 of article 900. Attachment may be made by any means known in the art including, but not limited to, hook and loop fasteners and a pocket into which pad 920 may be inserted. Using this arrangement, first shape correcting member 191, second shape correcting member 192 and third shape correcting member 193 may receive bony protrusions of a medial portion of a foot and present a flat surface to medial portion 806 of article 800.

In embodiments where a bootie or liner may be inserted into an article, a shape correcting member may be associated with the bootie or liner. In some cases, a shape correcting member may be fixedly attached to a bootie. In other cases, a shape correcting member may be integrally formed with a bootie.

Figure 10:
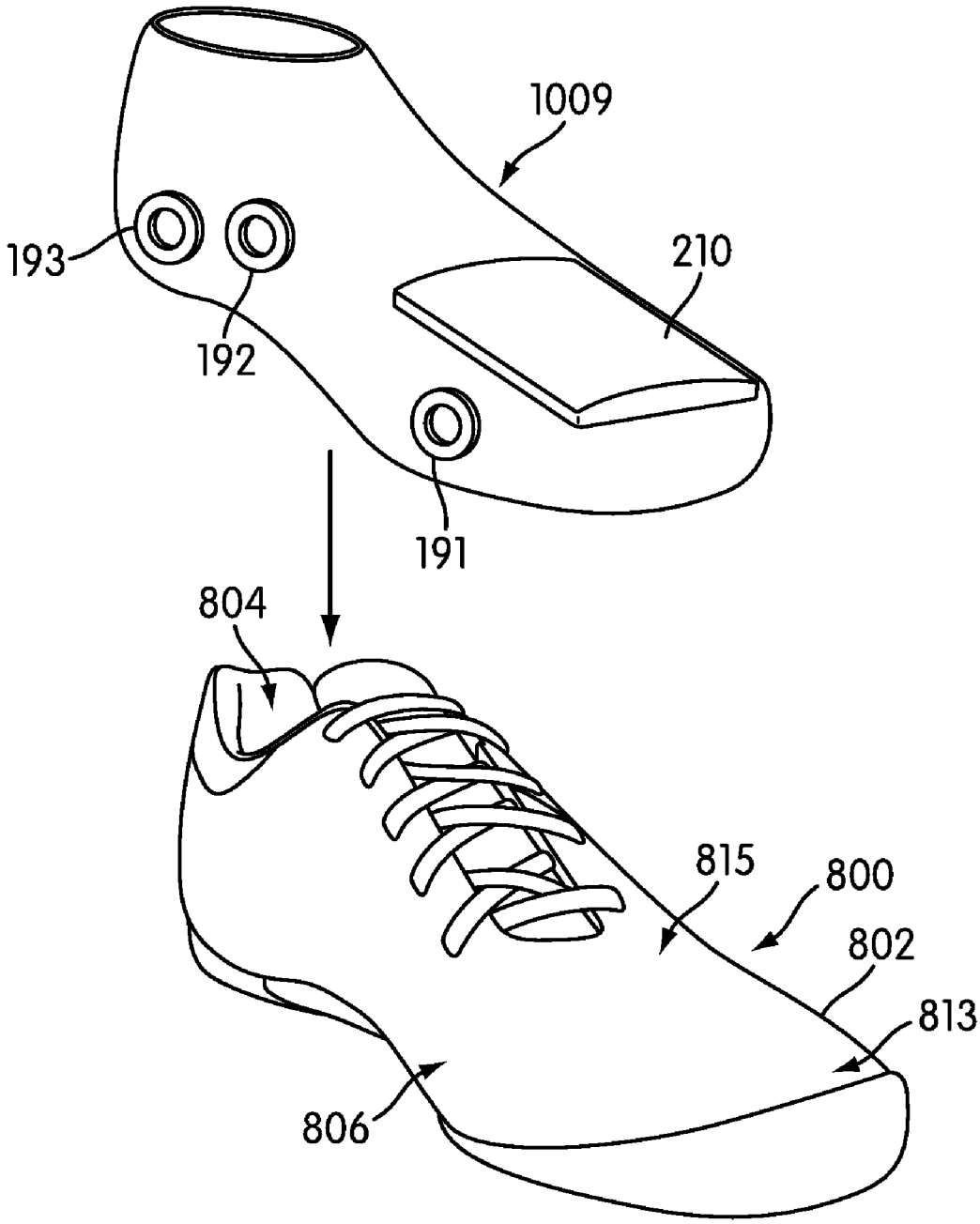
FIG. 10 is an exploded view of an exemplary embodiment of an article of footwear and a bootie with shape correcting members.

Referring to FIG. 10, bootie 1009 may be associated with article 800. Bootie 1009 includes first shape correcting member 191, second shape correcting member 192, third shape correcting member 193 and top shape correcting member 210. In one embodiment, first shape correcting member 191, second shape correcting member 192, third shape correcting member 193 and top shape correcting member 210 are integrally formed with bootie 1009. Furthermore, first shape correcting member 191, second shape correcting member 192, third shape correcting member 193 and top shape correcting member 210 are disposed on bootie 1009 so that first shape correcting member 191, second shape correcting member 192, third shape correcting member 193 and top shape correcting member 210 are disposed adjacent to bony protrusions of a foot as previously discussed.

After the insertion of bootie 1009 into article 800, first shape correcting member 191, second shape correcting member 192, third shape correcting member 193 and top shape correcting member 210 may be disposed on inner portion 804 of article 800. This configuration allows first shape correcting member 191, second shape correcting member 192 and third shape correcting member 193 to receive bony protrusions on a medial portion of a foot and provide a non-protruding surface for medial portion 806 of article 800. In a similar manner, top shape correcting member 210 may receive bony protrusions of a top portion of a foot and provide a non-protruding surface for middle portion 815 and toe portion 813 of article 800.

As previously discussed, when an article of footwear conforms to bony protrusions of a foot, an upper of an article may be configured with a bumpy or irregular surface. In some cases, a bumpy or irregular surface on an upper of an article may make it difficult to kick a ball accurately. In particular, a ball may rebound off a bumpy or irregular surface in an unpredictable manner.

Figure 11:
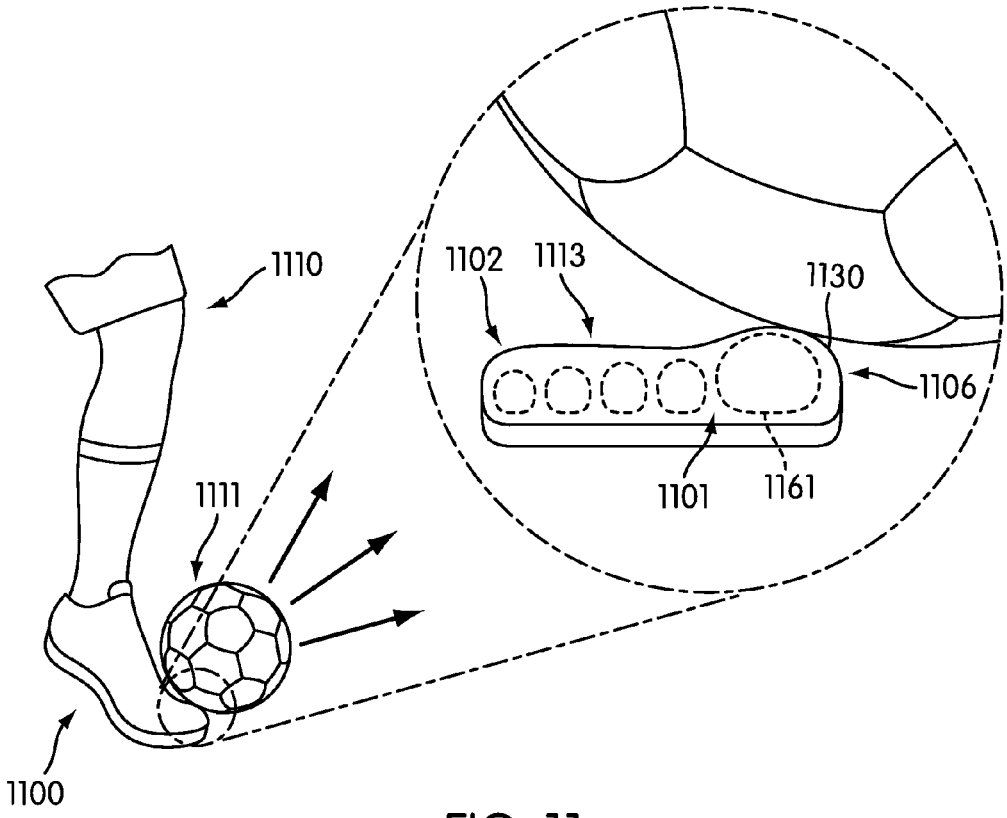
FIG. 11 is an isometric and an enlarged view of an exemplary embodiment of an article of footwear without shape correcting members kicking a ball.

FIG. 11 illustrates an exemplary embodiment of article 1100 without a shape correcting member. In some embodiments, article 1100 may be a soccer shoe. In other embodiments, article 1100 may be another type of shoe. In some cases, article 1100 includes upper 1102. Upper 1102 may be configured to conform to a right foot inserted within article 1100 in order to provide comfort and a good fit to a foot.

In one embodiment, upper 1102 conforms to foot 1101 inserted within upper 1102. In particular, upper 1102 conforms to bony protrusions of first metatarsal bone and phalanx bones of great toe 1161 of foot 1101. As upper 1102 conforms to the bony protrusions, medial portion 1106 and toe portion 1113 of upper 1102 may be configured with irregular surface 1130.

For illustrative purposes, FIG. 11 includes an enlarged view of irregular surface 1130. In this enlarged view, irregular surface 1130 may be exaggerated for illustrative purposes. It should be understood, however, that irregular surface 1130 is a surface without constant curvature. In other words, adjacent portions of irregular surface 1130 may comprise different angles of curvature. For example, irregular surface 1130 may be configured with a steeper curve adjacent to medial portion 1106 and a more gradual curve adjacent to a central portion of toe portion 1113.

If wearer 1110 kicks soccer ball 1111 with irregular surface 1130, wearer 1110 may have difficulty in kicking soccer ball 1111 accurately. Without a non-protruding consistent kicking surface, precise kicking of soccer ball 1111 may be difficult with irregular surface 1130. Furthermore, in rebound situations, soccer ball 1111 may rebound unpredictably off of irregular surface 1130.

Figure 12:
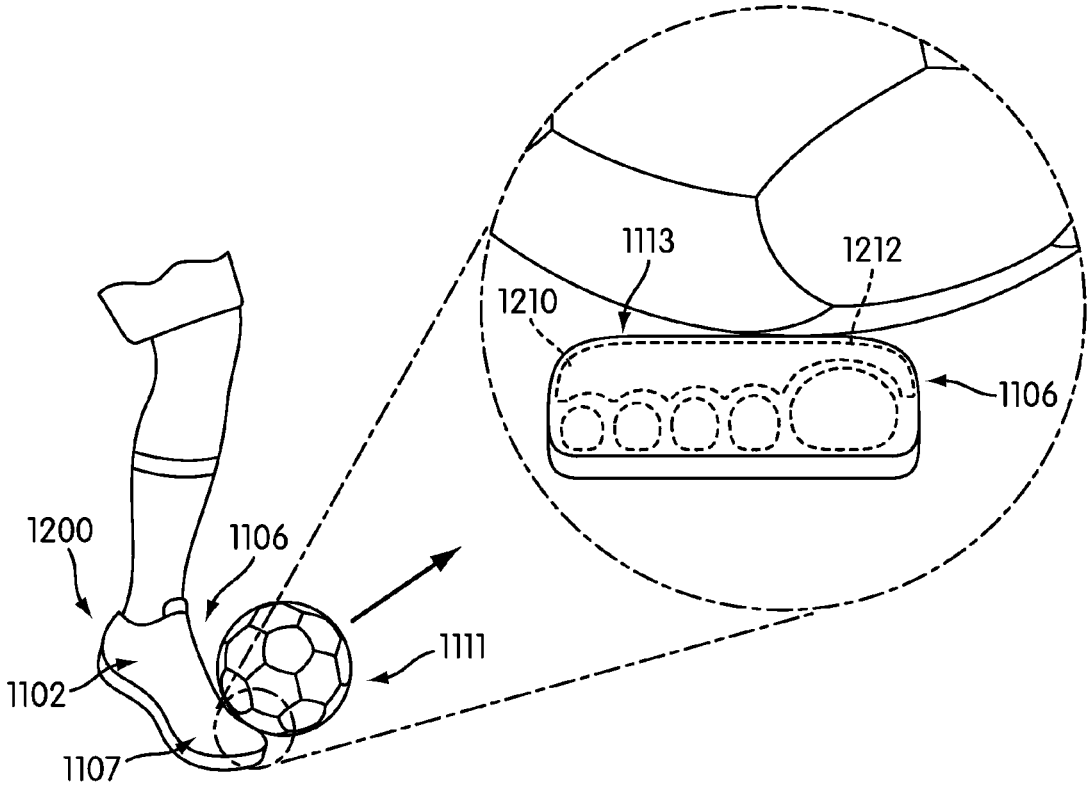
FIG. 12 is an isometric and an enlarged view of an exemplary embodiment of an article of footwear with shape correcting members kicking a ball.

A shape correcting member may correct a shape of a foot so that an article presents a non-protruding surface in an area adjacent to a bony protrusion of the foot. FIG. 12 illustrates an exemplary embodiment of article 1200 configured with top shape correcting member 1210. As previously discussed, outer surface 1212 of top shape correcting member 1210 presents a non-protruding surface on upper 1102 of article 1200. In particular, outer surface 1212 of top shape correcting member 1210 presents a non-protruding surface on toe portion 1113 and medial portion 1106 of article 1200. This non-protruding consistent surface facilitates accurate kicking.

Generally, shape correcting members may be constructed from various materials known in the art. Examples of materials include, but are not limited to: elastomers, siloxanes, natural rubber, other synthetic rubbers, aluminum, steel, composite materials, carbon fiber, natural leather, synthetic leather, foams, plastics as well as other materials. In some embodiments, a shape correcting member comprises a substantially rigid material. With this arrangement, the shape correcting member may facilitate accurate kicking. In some embodiments, a shape correcting member may comprise a heat and/or water molded material to more closely fit the foot of a wearer.

In one embodiment, top shape correcting member 1210 comprises a substantially rigid material. This substantially rigid material prevents top shape correcting member 1210 from deforming when soccer ball 1111 contacts medial portion 1106 of toe portion 1113. Furthermore, when soccer ball 1111 contacts medial portion 1106 of toe portion 1113, soccer ball 1111 contacts a non-protruding surface provided by outer surface 1212. With this configuration, outer surface 1212 is configured to facilitate accurate kicking of soccer ball 1111.

Figure 13:
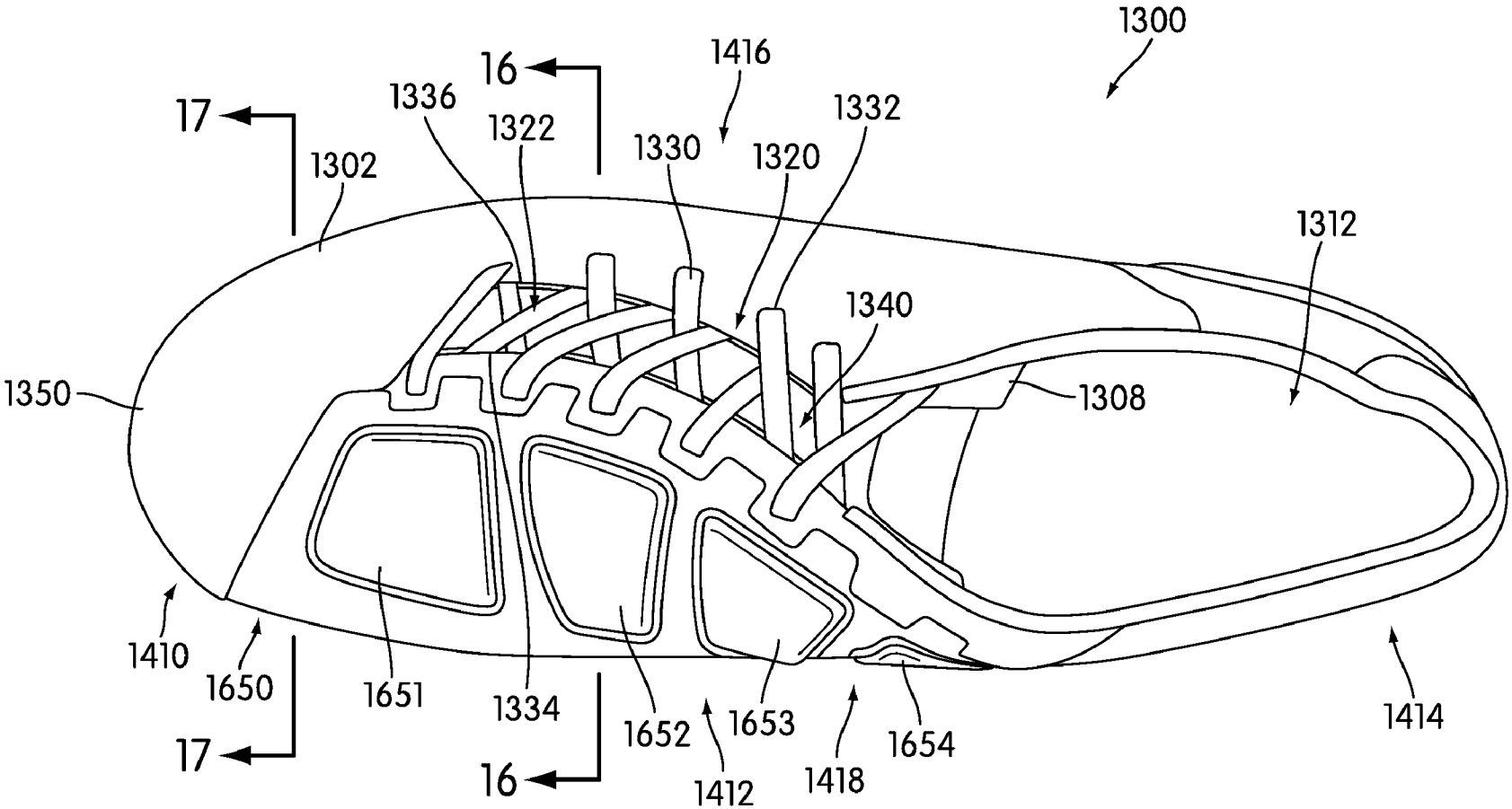
FIG. 13 is a top down view of an embodiment of an article of footwear including a shape correcting portion.
Figure 14:
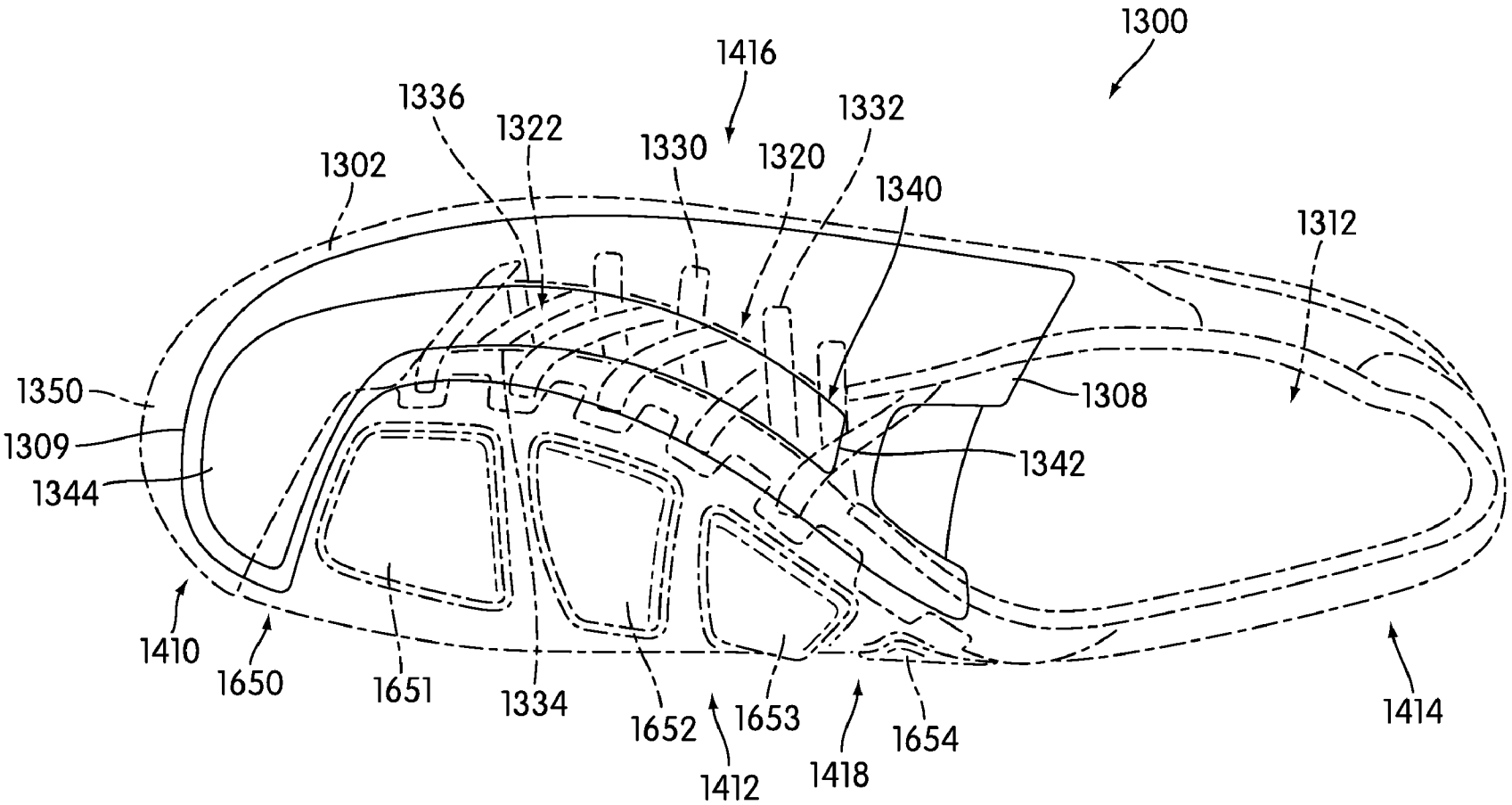
FIG. 14 is a top down view of an embodiment of a shape correcting portion associated with a tongue of the article.
Figure 15:
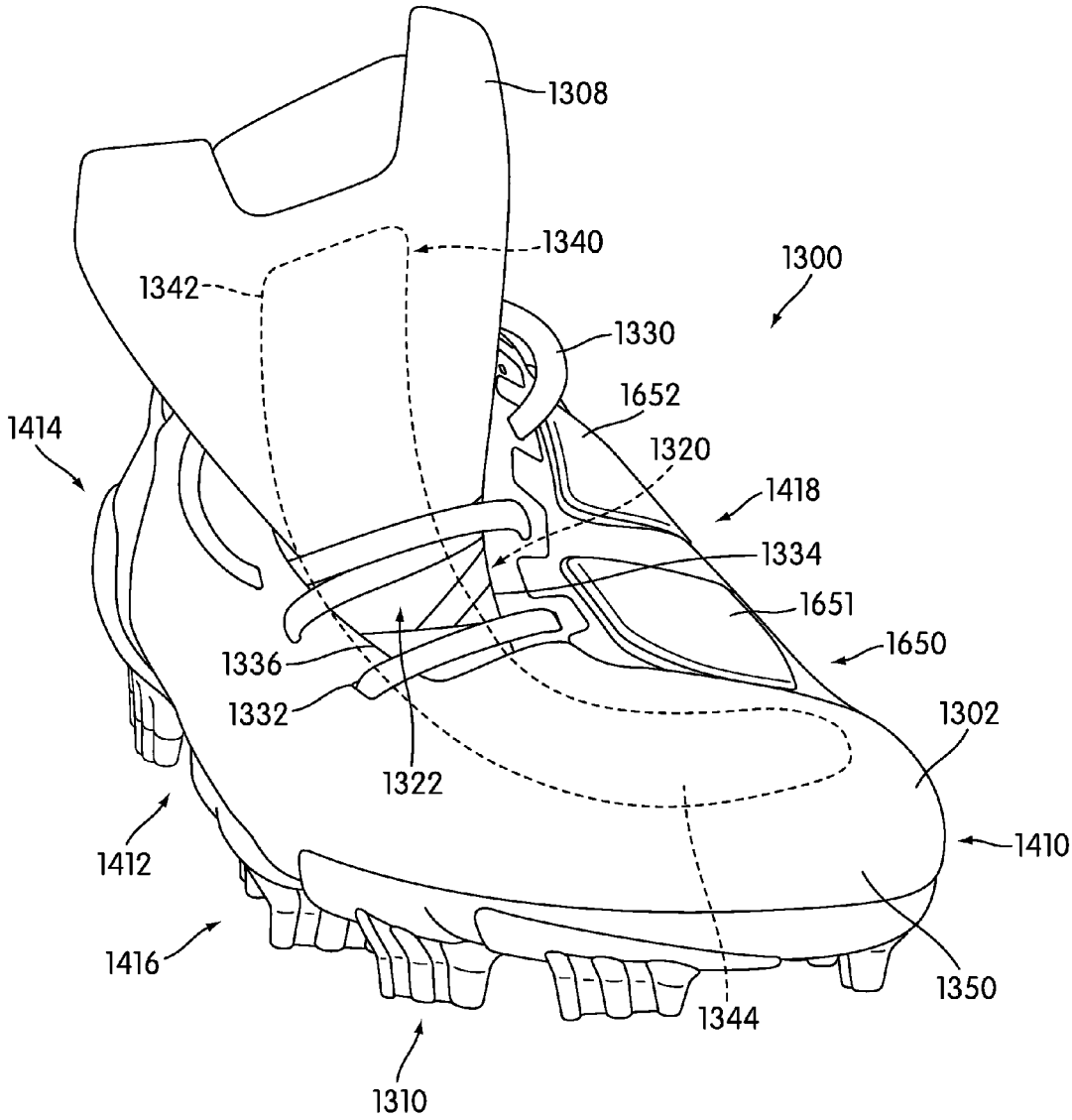
FIG. 15 is an isometric view of an embodiment of an article of footwear including a shape correcting portion associated with a tongue of the article.

FIGS. 13 through 17 illustrate an exemplary embodiment of article of footwear 1300. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIGS. 13 through 15, article of footwear 1300, also referred to simply as article 1300, is intended to be used with a right foot; however, it should be understood that the following discussion may equally apply to a mirror image of article of footwear 100 that is intended for use with a left foot.

Referring to FIGS. 13 through 17, for purposes of reference, article 1300 may be divided into forefoot portion 1410, midfoot portion 1412 and heel portion 1414. Forefoot portion 1410 may be generally associated with the toes and joints connecting the metatarsals with the phalanges. Midfoot portion 1412 may be generally associated with the arch of a foot. Likewise, heel portion 1414 may be generally associated with the heel of a foot, including the calcaneus bone. In addition, article 1300 may include lateral side 1416 and medial side 1418. In particular, lateral side 1416 and medial side 1418 may be opposing sides of article 1300. Furthermore, both lateral side 1416 and medial side 1418 may extend through forefoot portion 1410, midfoot portion 1412 and heel portion 1414.

It will be understood that forefoot portion 1410, midfoot portion 1412 and heel portion 1414 are only intended for purposes of description and are not intended to demarcate precise regions of article 1300. Likewise, lateral side 1416 and medial side 1418 are intended to represent generally two sides of an article, rather than precisely demarcating article 1300 into two halves. In addition, forefoot portion 1410, midfoot portion 1412 and heel portion 1414, as well as lateral side 1416 and medial side 1418, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole.

Article 1300 can include upper 1302 and sole structure 1310. Sole structure 1310 is secured to the upper and extends between the foot and the ground when article 1300 is worn. In different embodiments, sole structure 1310 may include different components. For example, sole structure 1310 may include an outsole, a midsole, and/or an insole. In some cases, one or more of these components may be optional.

Generally, upper 1302 may be any type of upper. In particular, upper 1302 could have any design, shape, size and/or color. For example, in embodiments where article 1300 is a basketball shoe, upper 1302 could be a high top upper that is shaped to provide high support on an ankle. In embodiments where article 1300 is a running shoe, upper 1302 could be a low top upper. In an exemplary embodiment, upper 1302 could be a low top type shoe designed for use in sports such as soccer.

In some embodiments, sole structure 1310 may be configured to provide traction for article 1300. In addition to providing traction, sole structure 1310 may attenuate ground reaction forces when compressed between the foot and the ground during walking, running or other ambulatory activities. The configuration of sole structure 1310 may vary significantly in different embodiments to include a variety of conventional or non-conventional structures. In some cases, the configuration of sole structure 1310 can be configured according to one or more types of ground surfaces on which sole structure 1310 may be used. Examples of ground surfaces include, but are not limited to: natural turf, synthetic turf, dirt, as well as other surfaces.

Article 1300 may be made from materials known in the art for making articles of footwear. For example, sole structure 1310 may be made from any suitable material, including, but not limited to: elastomers, siloxanes, natural rubber, other synthetic rubbers, aluminum, steel, natural leather, synthetic leather, or plastics. Also, upper 1302 may be made from any suitable material, including, but not limited to: nylon, natural leather, synthetic leather, natural rubber or synthetic rubber.

Article 1300 can include lacing system 1320. In some cases, lacing system 1320 can include medial lacing edge 1334 and lateral lacing edge 1336 that are separated by lacing gap 1322. In particular, lacing gap 1322 may extend from throat 1312 of upper 1302 towards forefoot portion 1410. In addition, lacing gap 1322 may be associated with lacing holes 1332 that are disposed on medial lacing edge 1334 and lateral lacing edge 1336. Furthermore, lacing gap 1322 may be further associated with lace 1330 that may be disposed through lacing holes 1332. With this arrangement, lace 1330 may be used to tighten upper 1302 around a foot.

In different embodiments, the shape of lacing gap 1322 can vary. In some cases, lacing gap 1322 may have a substantially straight shape. In other cases, lacing gap 1322 may have a curved shape. In one embodiment, lacing gap 1322 may be shaped to curve towards lateral side 1416 from throat 1312. In other words, lacing gap 1322 may be arranged in an asymmetric manner on upper 1302.

Article of footwear 1300 can include provisions for presenting a generally non-protruding outer surface for upper 1302. In some embodiments, article of footwear 1300 can include one or more shape correcting features. In one embodiment, article of footwear 1300 can include shape correcting system 1340. In some cases, shape correcting system 1340 can include first shape correcting portion 1342. In addition, shape correcting system 1340 can include second shape correcting portion 1344. In some cases, first shape correcting portion 1342 may be associated with lacing system 1320, while second shape correcting portion 1344 may be associated with toe region 1350 of forefoot portion 1410.

In some embodiments, first shape correcting portion 1342 and second shape correcting portion 1344 may be associated with tongue 1308. In some embodiments, first shape correcting portion 1342 may be configured as a raised portion of tongue 1308. In some cases, first shape correcting portion 1342 may comprise first shape correcting member 1346, which may be disposed between upper layer 1360 and lower layer 1362 of tongue 1308 (see FIG. 16). Likewise, second shape correcting portion 1344 may be disposed adjacent to end portion 1309 of tongue 1308. Also, second shape correcting portion 1344 may further comprise second shape correcting member 1348, which may be disposed between upper layer 1360 and lower layer 1362 (see FIG. 17) of tongue 1308.

In other embodiments, first shape correcting portion 1342 and second shape correcting portion 1344 can be associated with other portions of upper 1302. For example, in some cases, first shape correcting portion 1342 can be associated with a pad or liner of upper 1302. Likewise, in some cases, second shape correcting portion 1344 may be associated with a pad or liner of upper 1302. In another embodiment, first shape correcting portion 1342 may be associated with tongue 1308, while second shape correcting portion 1344 may be associated with a lining of upper 1302. Furthermore, it will be understood that in some embodiments, first shape correcting member 1346 and second shape correcting member 1348 can comprise a single shape correcting member. In other words, in some cases, first shape correcting member 1346 may be integrally formed with second shape correcting member 1348. In other embodiments, however, first shape correcting member 1346 and second shape correcting member 1348 can be distinct shape correcting members.

In different embodiments, the geometry of first shape correcting portion 1342 may vary. In some cases, first shape correcting portion 1342 can have a substantially rectangular shape. In other cases, first shape correcting portion 1342 can have any shape, including, but not limited to, rounded shapes, polygonal shapes, regular shapes, irregular shapes, curved shapes as well as any other type of shapes. In one embodiment, first shape correcting portion 1342 may have a shape that corresponds to the shape of lacing gap 1322. In particular, first shape correcting portion 1342 may be curved in a similar manner to the curved shape of lacing gap 1322.

In different embodiments, the length of first shape correcting portion 1342 can vary. In some embodiments, the length of first shape correcting portion 1342 may substantially greater than the length of lacing gap 1322. In other embodiments, the length of first shape correcting portion 1342 may be substantially less than the length of lacing gap 1322. In an exemplary embodiment, the length of first shape correcting portion 1342 may be approximately equal to the length of lacing gap 1322.

Figure 16:
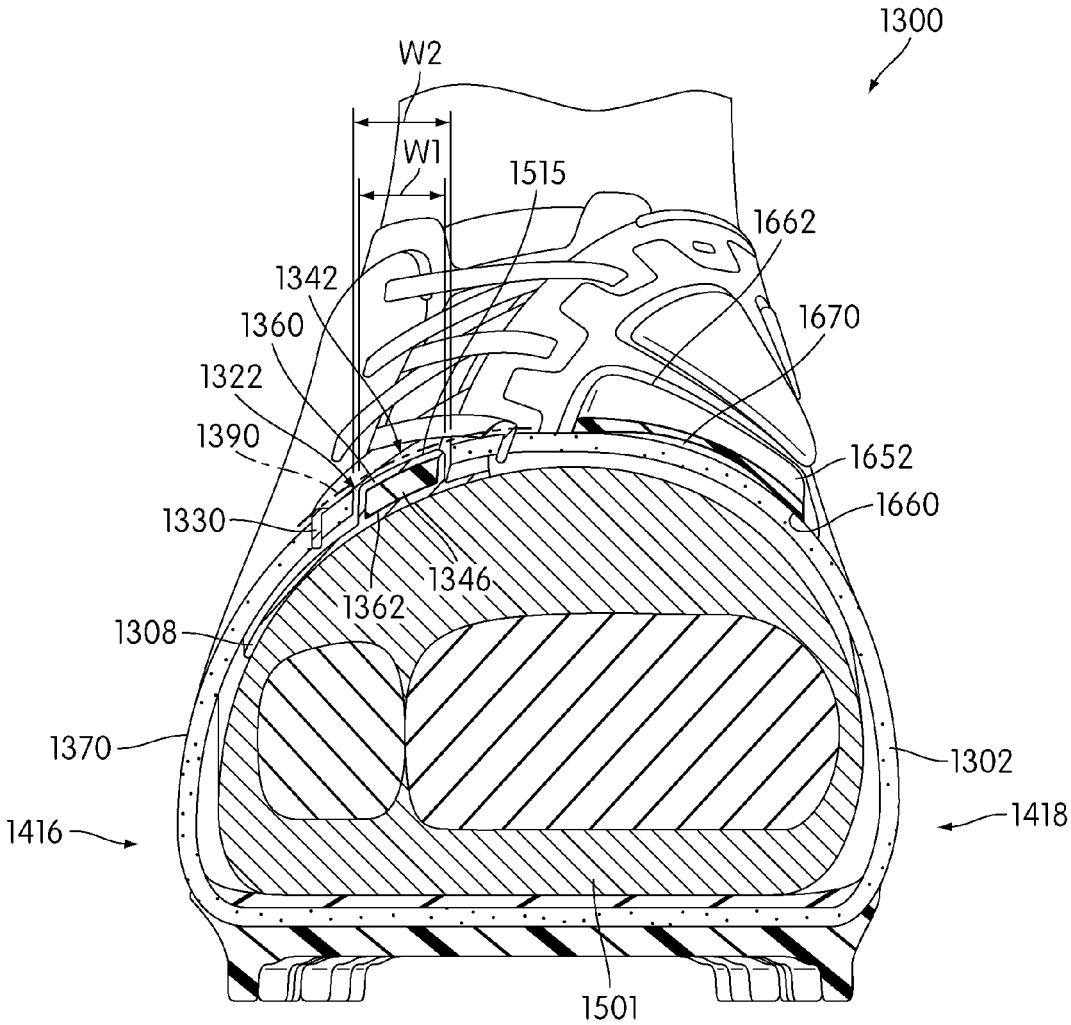
FIG. 16 is a schematic cross sectional view of an embodiment of a shape correcting portion associated with a tongue of an article.

In different embodiments, the width of first shape correcting portion 1342 can also vary. In some embodiments, the width of first shape correcting portion 1342 can be selected according to the width of lacing gap 1322. In the current embodiment, first shape correcting portion 1342 may have a width W1, as illustrated in FIG. 16. In addition, lacing gap 1322 may have a width W2. In some cases, width W1 may be substantially greater than width W2. In other cases, width W1 may be substantially less than width W2. In one embodiment, width W1 may be approximately equal to width W2. For purposes of clarity, a single width is used to describe the width of first shape correcting portion 1342 as well as the width of lacing gap 1322. However, it will be understood that in some embodiments the widths of both first shape correcting portion 1342 and lacing gap 1322 may vary in the longitudinal direction. In these embodiments, width W1 and width W2 may be associated with average widths of first shape correcting portion 1342 and lacing gap 1322, respectively.

In different embodiments, the thickness of first shape correcting portion 1342 can vary. In some cases, the thickness of first shape correcting portion 1342 can be selected so that outer surface 1515 of first shape correcting portion 1342 is approximately even with upper surface 1370 of upper 1302 at lacing gap 1322. In particular, the thickness of first shape correcting portion 1342 can be approximately equal to the distance between the top of foot 1501 and upper surface 1370. In other cases, the thickness of first shape correcting portion 1342 may be selected so that outer surface 1515 of first shape correcting portion 1342 is disposed below upper surface 1370. In still other embodiments, the thickness of first shape correcting portion 1342 may be selected so that outer surface 1515 is disposed above upper surface 1370. In addition, it will be understood that the size of first shape correcting portion 1342, including length, width and thickness, can be varied by adjusting the size of first shape correcting member 1346 as well as by adjusting the thickness of upper layer 1360 and lower layer 1362 of tongue 1308.

In the current embodiment, first shape correcting portion 1342 may be configured to fill lacing gap 1322 when upper 1302 is tightened around a foot. In particular, first shape correcting portion 1342 can be configured to span lacing gap 1322 in a manner that provides an approximately non-protruding outer surface for upper 1302. In one embodiment, upper surface 1370 of upper 1302 and outer surface 1515 of first shape correcting portion 1342 may approximately comprise non-protruding surface 1390 in the region around lacing gap 1322. With this arrangement, in situations where a ball contacts lateral side 1416 during a kick, upper 1302 may present a substantially non-protruding outer surface to the ball at lacing gap 1322 to facilitate increased ball control. In particular, this arrangement can reduce undesired ball trajectories that may occur when a ball strikes an irregular surface.

In different embodiments, the shape of second shape correcting portion 1344 can vary. Examples of shapes include, but are not limited to rounded shapes, polygonal shapes, regular shapes, irregular shapes, curved shapes as well as any other type of shapes. In one embodiment, second shape correcting portion 1344 can have a substantially rounded shape.

In different embodiments, the size of second shape correcting portion 1344 can vary. In one embodiment, second shape correcting portion 1344 may have a size that provides substantial coverage over one or more bony protrusions associated with the toes of a foot. In particular, second shape correcting portion 1344 may be have a size that extends over a region including the heads of one or more metatarsal bones of the foot, as discussed above.

Generally, the width of second correcting portion 1344 can vary. In some cases, the width of second shape correcting portion 1344 can span substantially the whole width of upper 1302 at toe region 1350. In other cases, the width of second shape correcting portion 1344 can be less than the width of upper 1302 at toe region 1350.

Figure 17:
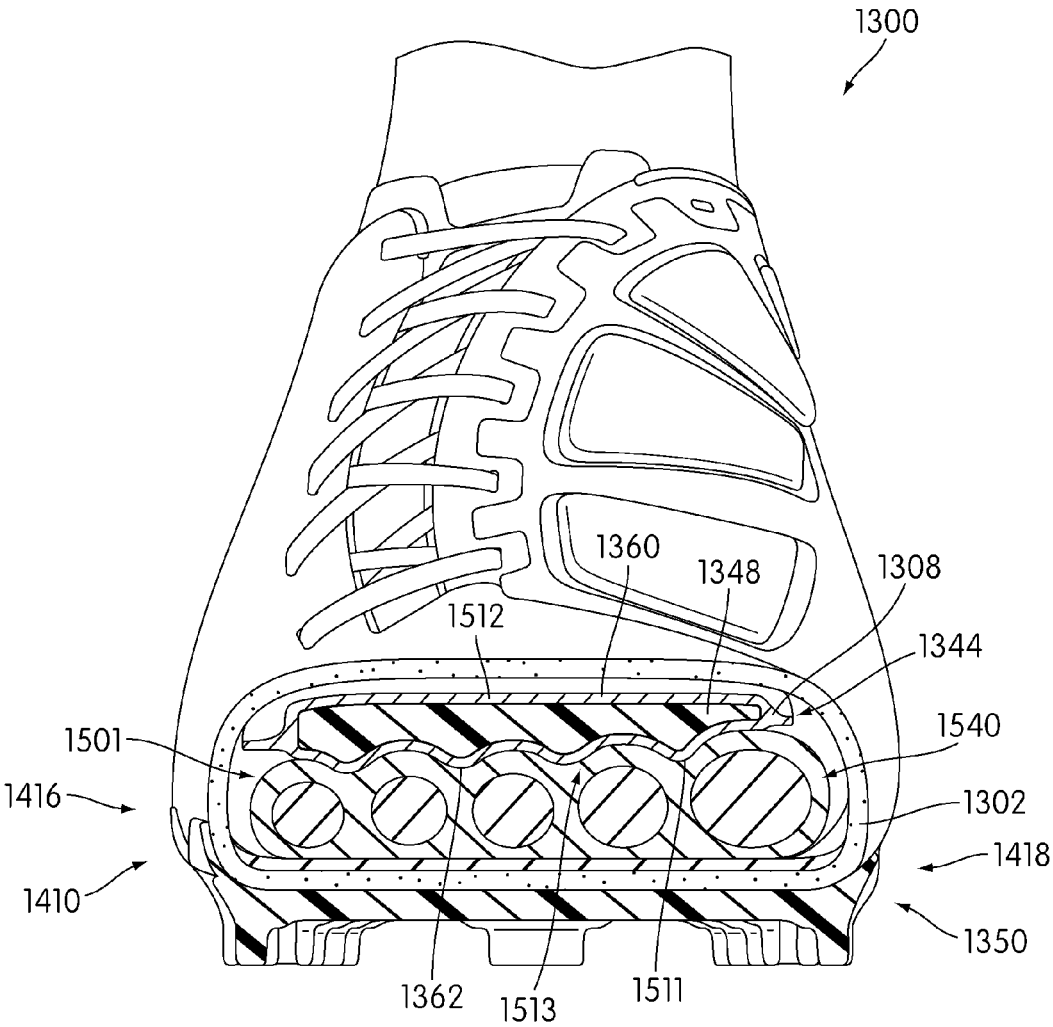
FIG. 17 is a schematic cross sectional view of an embodiment of a shape correcting portion associated with a toe portion of an article.

Referring to FIG. 17, a top portion of foot 1501 may be associated with second shape correcting portion 1344. In particular, a top portion of foot 1501 may be associated with inner surface 1511 of second shape correcting portion 1344. In addition, second shape correcting portion 1344 includes outer surface 1512 disposed opposite inner surface 1511.

In an exemplary embodiment, inner surface 1511 includes plurality of pre-formed cavities 1513. Generally, plurality of pre-formed cavities 1513 may include any number of cavities. In some embodiments, plurality of pre-formed cavities 1513 include cavities to receive bony protrusions of metatarsal bones 1540 of foot 1501. In other embodiments, plurality of pre-formed cavities 1513 may include cavities to receive bony protrusions of phalanx bones of foot 1501. In still other embodiments, plurality of pre-formed cavities 1513 may include cavities to receive bony protrusions of metatarsal bones 1540 and phalanx bones of foot 1501. In one embodiment, plurality of pre-formed cavities 1513 include cavities to receive bony protrusions of metatarsal bones 1540 and proximal phalanx bones of foot 1501 in a similar manner to the previous embodiment discussed above.

Although the current embodiment includes shape correcting members including cavities, in other embodiments a cavity of a shape correcting member can be filled with one or more materials. In one embodiment, each cavity of plurality of pre-formed cavities 1513 may be filled with a material having a different rigidity than a material comprising second shape correcting member 1348. For example, in one embodiment, each cavity of pre-formed cavities 1513 may be filled with a foam material, while second shape correcting member 1348 may be made of a durable rubber material that is more rigid than the foam material. With this arrangement, bony protrusions may still be received within plurality of pre-formed cavities 1513.

In the current embodiment, plurality of pre-formed cavities 1513 of second shape correcting portion 1344 may be associated with cavities of second shape correcting member 1348. Furthermore, lower layer 1362 of tongue 1308 may be configured to conform to the shape of plurality of pre-formed cavities 1513 in order to maintain space for receiving bony protrusions of foot 1501.

In the current embodiment, outer surface 1512 of second shape correcting portion 1344 may be substantially non-protruding. In some embodiments, outer surface 1512 may be a substantially flat surface. In an exemplary embodiment, outer surface 1512 is rounded with an approximately constant curvature. This arrangement allows outer surface 1512 of first shape correcting portion 1510 to present a non-protruding surface for toe portion 1410 of upper 1302 in areas adjacent to bony protrusions of metatarsal bones 1540 and proximal phalanx bones. Using the arrangement, toe portion 1350 of upper 1302 may be present a substantially non-protruding surface for kicking a ball.

Referring to FIGS. 13 through 17, although the current embodiment illustrates the use of shape correcting members disposed within portions of upper 1302, other embodiments could include shape correcting members disposed on exterior portions of upper 1302. In another embodiment, external shape correcting members could be disposed on various regions of upper surface 1370 of upper 1302. For example, in one embodiment, article of footwear 1300 may include plurality of external shape correcting members 1650. In particular, plurality of external shape correcting members 1650 may include first external shape correcting member 1651, second external shape correcting member 1652, third external shape correcting member 1653 and fourth external shape correcting member 1654.

Referring to FIG. 16, second external shape correcting member 1652 can include inner surface 1660 that confronts upper surface 1370 as well as outer surface 1662 that is disposed opposite of inner surface 1660. In addition, inner surface 1660 can include cavity 1670. In some cases, cavity 1670 can be configured to receive protrusions from medial side 1418 of foot 1501 as upper 1302 is depressed against foot 1501 during impact with a ball. In a similar manner, first external shape correcting member 1651, third external shape correcting member 1653 and fourth external shape correcting member 1654 may be configured with one or more cavities to provide shape correction for different regions of upper 1302. With this arrangement, each external shape correcting member may be configured to receive bony protrusions or other protruding features of a foot while maintaining a substantially non-protruding outer surface for contact with a ball.

Figure 18:
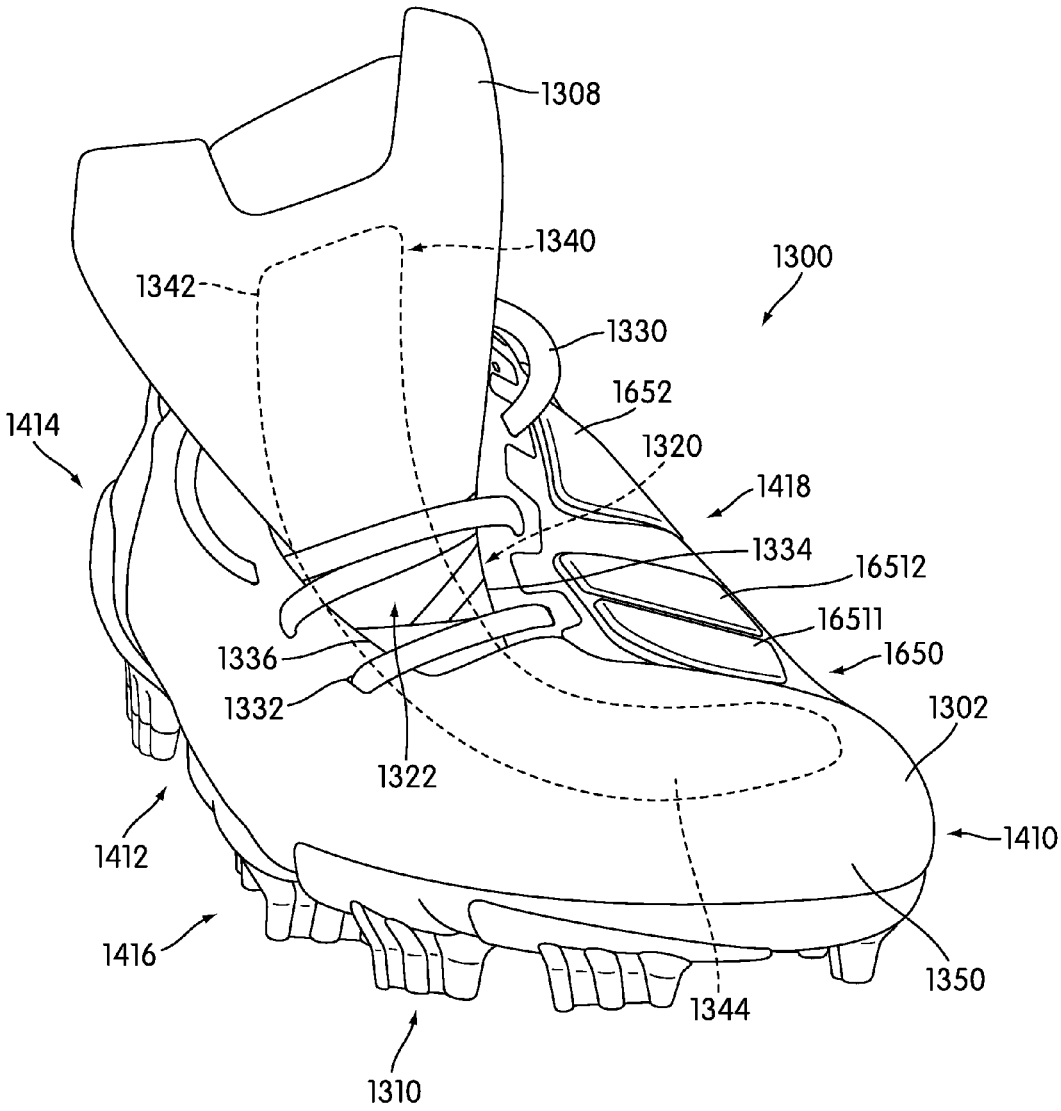
FIG. 18 is an isometric view of an embodiment of an article of footwear including external shape correcting portions.

In an embodiment shown in FIG. 18, first external shape correcting member 1651 of the previous embodiment may be divided into two external shape correcting members 16511 and 16512 to provide more versatility in shape correction.

Although a single cavity is used with an external shape correcting member in the current embodiment, other embodiments could include additional cavities and/or holes. Furthermore, in different embodiments the shapes and sizes of each cavity and/or hole can vary. Still further, it will be understood that the locations of plurality of external shape correcting members 1650 are intended to be exemplary. In other embodiments, external shape correcting members could be associated with any other region of upper 1302. In addition, in other embodiments, external shape correcting members can be associated with any sizes and/or shapes.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising:

a shape correcting member including an inner surface disposed in a portion of the article of footwear corresponding with a top portion of a foot and an outer surface disposed opposite the inner surface;

the article of footwear having a medial side and a lateral side, wherein a lateral direction extends between the medial side and lateral side;

the inner surface including a plurality of laterally-spaced, pre-formed cavities; and wherein at least one of the pre-formed cavities is configured to receive a metatarsal bone of a foot; and wherein the shape correcting member comprises a first material and at least one cavity of the plurality of pre-formed cavities is at least partially filled with a second material, wherein the first material is more rigid than the second material.

2. The article of footwear according to claim 1, wherein the shape correcting member includes an extended portion associated with the inner surface, wherein the extended portion is configured to insert between two adjacent metatarsal bones of the foot.

3. The article of footwear according to claim 1, wherein the shape correcting member is disposed adjacent to an end portion of the tongue and adjacent to a toe portion of the upper.

4. The article of footwear according to claim 1, wherein the inner surface is shaped to fit to the contours of the top portion of the foot, the plurality of laterally-spaced, pre-formed cavities including five pre-formed cavities, each cavity being configured to receive a bony protrusion of a different metatarsal bone of the foot.

5. The article of footwear according to claim 1, wherein the outer surface is substantially non-protruding.

6. The article of footwear according to claim 5, wherein the outer surface has an approximately constant curvature.

7. An article of footwear, comprising:

an upper including a shape correcting member;

the shape correcting member disposed on an inner portion of the upper, the shape correcting member including a central hole configured to receive a bony protrusion of a foot;

the article of footwear having a medial side and a lateral side wherein a lateral direction extends between the medial side and lateral side; and a second shape correcting member disposed in a portion of the article of footwear corresponding with a top portion of a foot, the second shape correcting member having an inner surface including a plurality of laterally-spaced, pre-formed cavities, wherein at least one cavity of the plurality of cavities is configured to receive a bony protrusion of the top portion of the foot;

wherein the second shape correcting member presents a flat outer surface for the upper, opposite the inner surface, in an area adjacent to the bony protrusion; and wherein at least two of the pre-formed cavities are differently sized.

8. The article of footwear according to claim 7, wherein the second shape correcting member is disposed adjacent to an end portion of the tongue and adjacent to a toe portion of the upper.

9. The article of footwear according to claim 7, wherein the at least one cavity is configured to receive a bony protrusion of a navicular bone of the foot.

10. The article of footwear according to claim 7, wherein the at least one cavity is configured to receive a bony protrusion of a metatarsal bone of the foot.

11. The article of footwear according to claim 10, wherein the plurality of laterally-spaced, pre-formed cavities include five pre-formed cavities, wherein each of the five pre-formed cavities is configured to receive a bony protrusion of a different metatarsal bone of the foot.

12. The article of footwear according to claim 7, wherein the at least one cavity is configured to receive a bony protrusion of a metatarsal head of the foot.

13. An article of footwear, comprising;

a shape correcting member disposed on a top portion of the article of footwear and including an inner surface corresponding with a top portion of a foot and an outer surface disposed opposite of the inner surface;

the article of footwear having a medial side and a lateral side, wherein a lateral direction extends between the medial and lateral side; and the inner surface including a plurality of laterally spaced, pre-formed cavities, configured to fit to the contours of the top portion of the foot;

wherein the outer surface is a substantially non-protruding surface having an approximately constant curvature.

14. The article of footwear according to claim 13, wherein the plurality of laterally-spaced, pre-formed cavities include five pre-formed cavities, wherein each of the five pre-formed cavities is configured to receive a bony protrusion of a different metatarsal bone of the foot.

15. The article of footwear according to claim 14, wherein the shape correcting member includes an extended portion associated with the inner surface, wherein the extended portion is configured to insert between two adjacent metatarsal bones of the foot.

16. The article of footwear according to claim 13, wherein the shape correcting member includes an inner surface including at least one cavity configured to receive a bony protrusion of the top portion of the foot.

17. The article of footwear according to claim 16, wherein the at least one cavity is configured to receive a bony protrusion of a metatarsal bone of the foot.

18. The article of footwear according to claim 13, wherein the shape correcting member is integrally formed with an upper of the article of footwear.

19. The article of footwear according to claim 13, wherein the shape correcting member is removably attachable to an upper of the article of footwear.

20. The article of footwear according to claim 13, wherein the shape correcting member is integrally formed with a bootie that is removable from an upper of the article of footwear.

21. The article of footwear according to claim 13, wherein the shape correcting member is a first shape correcting member configured to receive a first bony protrusion of the foot and wherein the article includes a second shape correcting member configured to receive a second bony protrusion of the foot.

22. The article of footwear according to claim 21, wherein the first shape correcting member and the second shape correcting member are embedded within a pad.

23. The article of footwear according to claim 13, wherein the upper of the article of footwear includes a tongue, and the shape correcting member is configured as a raised portion of the tongue.

24. The article of footwear according to claim 13, wherein the upper of the article of footwear includes a tongue, and wherein the shape correcting member is disposed between an upper layer of the tongue and a lower layer of the tongue.

25. The article of footwear according to claim 13, wherein the upper of the article of footwear includes a tongue, and wherein the shape correcting member is disposed adjacent to an end portion of the tongue and wherein the shape correcting member is disposed adjacent to a toe portion of the upper.

26. The article of footwear according to claim 13, wherein the shape correcting member is disposed on an external surface of the upper.

27. An article of footwear, comprising:

an upper including a lacing region corresponding with a top portion of a foot;

the article of footwear having a medial side and a lateral side, wherein a lateral direction extends between the medial side and lateral side;

the lacing region including a medial lacing edge and a lateral lacing edge, the medial lacing edge and the lateral lacing edge being separated by a lacing gap; and a shape correcting portion having a shape corresponding to the lacing gap;

the shape correcting portion having an inner surface including a plurality of laterally spaced, pre-formed cavities, wherein at least one of the pre-formed cavities is configured to receive a bony protrusion of the top portion of the foot;

wherein the shape correcting portion is disposed adjacent to the lacing gap when the upper is tightened around a foot and wherein the shape correcting member provides a substantially non-protruding surface for the upper at the lacing gap.

28. The article of footwear according to claim 27, wherein the upper of the article of footwear includes a tongue, and wherein the shape correcting portion is disposed on the tongue.

29. The article of footwear according to claim 28, wherein the shape correcting portion comprises a shape correcting member disposed between an upper layer of the tongue and a lower layer of the tongue.

30. The article of footwear according to claim 27, wherein a width of the shape correcting portion is approximately equal to a width of the lacing gap.

31. The article of footwear according to claim 27, wherein a length of the shape correcting portion is approximately equal to a length of the lacing gap.

32. The article of footwear according to claim 27, wherein at least one of the pre-formed cavities is configured to receive a bony protrusion of a metatarsal bone of the foot.

33. The article of footwear according to claim 32, wherein the laterally spaced, pre-formed cavities include five pre-formed cavities, wherein each of the five pre-formed cavities is configured to receive a bony protrusion of a different metatarsal bone of the foot.

34. The article of footwear according to claim 33, wherein the shape correcting portion includes an extended portion associated with the inner surface, wherein the extended portion is configured to insert between two adjacent metatarsal bones of the foot.

* * * * *